US011484105B2

(12) United States Patent
Majhess

(10) Patent No.: US 11,484,105 B2
(45) Date of Patent: Nov. 1, 2022

(54) LUGGAGE HAVING INTEGRATED COMPRESSION SYSTEM WITH REMOVABLE BATTERY

(71) Applicant: Obsidian Luggage Technologies International, Inc., San Juan, PR (US)

(72) Inventor: Joseph M. Majhess, Boca Raton, FL (US)

(73) Assignee: OBSIDIAN LUGGAGE TECHNOLOGIES INTERNATIONAL, INC., San Juan, PR (US)

( * ) Notice: Subject to any disclaimer, the term of this patent is extended or adjusted under 35 U.S.C. 154(b) by 335 days.

(21) Appl. No.: 16/538,773

(22) Filed: Aug. 12, 2019

(65) Prior Publication Data

US 2020/0253348 A1 Aug. 13, 2020

Related U.S. Application Data

(63) Continuation-in-part of application No. 16/272,272, filed on Feb. 11, 2019, now Pat. No. 10,376,031.

(51) Int. Cl.
*A45C 13/03* (2006.01)
*A45C 5/03* (2006.01)
(Continued)

(52) U.S. Cl.
CPC ..... *A45C 13/03* (2013.01); *A45C 5/03* (2013.01); *A45C 5/14* (2013.01); *A45C 13/021* (2013.01);
(Continued)

(58) Field of Classification Search
CPC .. A45C 13/03; A45C 5/03; A45C 5/14; A45C 13/021; A45C 13/103; A45C 13/262; A45C 2013/028; A45C 2013/267
See application file for complete search history.

(56) References Cited

U.S. PATENT DOCUMENTS 6,408,872 B1 6/2002 Skeens
6,971,417 B2 * 12/2005 Deni ..... B65B 31/047 141/114

(Continued)

*Primary Examiner* — Tri M Mai
(74) *Attorney, Agent, or Firm* — Daniel S. Polley, P.A.

(57) ABSTRACT

Luggage having an integrated compression system where at least one vacuum compression bag is provided and secured within the interior space of the luggage. The bag can be compressed by an attached self-contained vacuum assembly removably secured within the luggage, preferably between the handle tube guides. The air outlet opening of the bag can be provided with a valve or coupling for securement to the air entry inlet of the vacuum assembly. The bag can also be removably secured to other areas within the interior of the luggage. An air outlet of the vacuum assembly can be provided with a valve or coupling for securement to an opening in the back wall of the luggage. Alternatively, the valve or coupling can be provided in the back wall opening. Air removed from the compression bag by the vacuum assembly is expelled through the back wall opening, without the use of any exposed hoses. This allows the oversized compression bag as compared to the size of the luggage and the contents stored within the bag to be able to safely contain within the fully closed luggage. The battery for powering the vacuum assembly can be removable while the luggage is fully closed and can also be used to charge other electronic devices.

24 Claims, 22 Drawing Sheets

(51) Int. Cl.

| | |
|---|---|
| ***A45C 5/14*** | (2006.01) |
| ***A45C 13/02*** | (2006.01) |
| ***A45C 13/10*** | (2006.01) |
| ***A45C 13/26*** | (2006.01) |

(52) U.S. Cl.
CPC ..... *A45C 13/103* (2013.01); *A45C 13/262* (2013.01); *A45C 2013/028* (2013.01); *A45C 2013/267* (2013.01)

(56) References Cited

U.S. PATENT DOCUMENTS

| | | | | |
|---|---|---|---|---|
| 9,296,541 | B2 | 3/2016 | Turvey | |
| 9,966,771 | B2 * | 5/2018 | Cross | H02J 7/0063 |
| 10,219,599 | B2 | 3/2019 | Korey | |
| 10,334,927 | B2 | 7/2019 | Korey | |
| 10,376,031 | B1 * | 8/2019 | Majhess | A45C 5/03 |
| 2015/0101958 | A1 * | 4/2015 | Cross | A45C 13/02 206/702 |
| 2017/0127782 | A1 | 5/2017 | Korey | |
| 2017/0310151 | A1 * | 10/2017 | Curescu | A45C 13/262 |
| 2018/0255895 | A1 | 9/2018 | Korey | |
| 2019/0069659 | A1 * | 3/2019 | Van Loon | A45C 9/00 |
| 2019/0254401 | A1 * | 8/2019 | Rubio | A45C 13/28 |
| 2021/0093064 | A1 * | 4/2021 | Roosen | A45C 15/00 |

* cited by examiner

CAVITY C

LUGGAGE HAVING INTEGRATED COMPRESSION SYSTEM WITH REMOVABLE BATTERY

This application is a continuation-in-part of U.S. Application Ser. No. 16/272,272, filed Jun. 27, 2019, which is incorporated by reference in its entirety for all purposes.

1. Field of the Disclosure

The disclosure relates generally to travel luggage and more particularly to a novel travel luggage having an integrated compression system with removable battery.

2. Background

The use of a separate clothing compression bags for reducing the space required for the clothing in a suitcase or piece of luggage (collectively "Luggage") is known and allows more clothing to be packed in the same internal space as compared to the amount of clothing that will fit in such space without the use of the compression bag. More recently, clothing compression bags have been incorporated with the Luggage as opposed to be a separate item that is thrown into Luggage at the time of use. However, Luggage incorporating these clothing compression bags suffer from one or more problems, including without limitation, use non-removable components including non-removable batteries, significantly increases the weight of the Luggage which often cause the weight to exceed an airline threshold resulting in additional fees having to be paid by the traveler, may not comply with Federal/International laws and regulations regarding the contents contained within the Luggage, such as but not limited to, battery types, etc.

It is to eliminating or reducing the above problems and other problems currently associated within current Luggage having compression or vacuum bags that the below disclosed novel Luggage is directed.

SUMMARY OF THE DISCLOSURE

Generally disclosed is a novel piece of luggage having an integrated compression system including a vacuum or compression bag (collectively "compression bag"). Preferably, at least one vacuum compression bag can be provided and secured within the interior space of the luggage. The bag can be preferably attached to the interior of the luggage. The bag can be provided with a valve, coupling or other connection device (preferably constituting a male portion of the connection mechanism) which engages and is aligned with an air entry conduit of a self-contained vacuum attachment. Preferably, all or most of the components are contained within an outer housing or box and hidden. The outer box/housing is preferably removably secured within the luggage. The vacuum attachment can be provided with an air exit conduit which engages and aligns with a valve located within an opening in the back wall of the luggage, which provides for a one-way air travel hole (i.e. air can be expelled out of the luggage through the opening, but air is not permitted to enter the opening into the luggage). The one-way valve can also be disposed within an air exit conduit of the vacuum assembly that is contained within the vacuum housing/box. The bag can be compressed through use of the self-contained vacuum attachment, by removing the air from the bag, in connection with the pump component of the vacuum attachment and expelling the air removed from the bag through the one-way hole located in the back wall of the luggage. Preferably, the entire operation of compressing the bag, while filled with travel contents, such that the bag and contents is permitted to fit within the interior of the luggage, is preferably provided without the use of any exposed, independent or loose hoses, and only the conduits (hidden and disposed within the vacuum housing) that form part of the self-contained vacuum attachment are used for expelling the air of the luggage through the rear of the vacuum attachment, without the use of any hoses.

The vacuum housing can be fitted or otherwise secured to the conventional handle guide tubes which are mounted within an interior surface of a back wall of the luggage or can secured, preferably removably, to another location within the luggage. Thus, the vacuum assembly, including the air conduits contained within the vacuum assembly can be disposed within the area of the luggage between the handle guide tubes, such that the vacuum assembly virtually does not consume any of the interior area of the luggage used for storing travel items.

A component of the vacuum assembly can be a removable battery, that can be externally removed or externally inserted in place within a receiving cavity of the vacuum housing through an opening in the upper wall portion of the luggage. Therefore, the battery can be removable and insertable even with the luggage in a fully closed position. The removable battery preferably can be rechargeable and can be provided with one or more USB ports, other electrical ports and/or electrical outlets to allow it to also charge other electronic devices that the user (i.e. traveler, etc.) may also be carrying, such as, without limitation, smartphones and tablets. In one non-limiting preferred embodiment, the battery can be a removable lithium ion battery that is used to power the vacuum assembly, as well as recharge other electronic devices, while also providing power to a control panel that is also preferably provided and preferably incorporated into the upper wall portion of the luggage shell in one non-limiting embodiment.

BRIEF DESCRIPTION OF THE DRAWINGS

FIG. 34B illustrates screw bosses that can be used for receipt of the screws for securing the pump in one non-limiting embodiment in accordance with the present disclosure; and FIG. 34C illustrates one non-limiting mechanical connection for securing the pump within the suitcase in accordance with the present disclosure.

DETAILED DESCRIPTION

Figure 1:
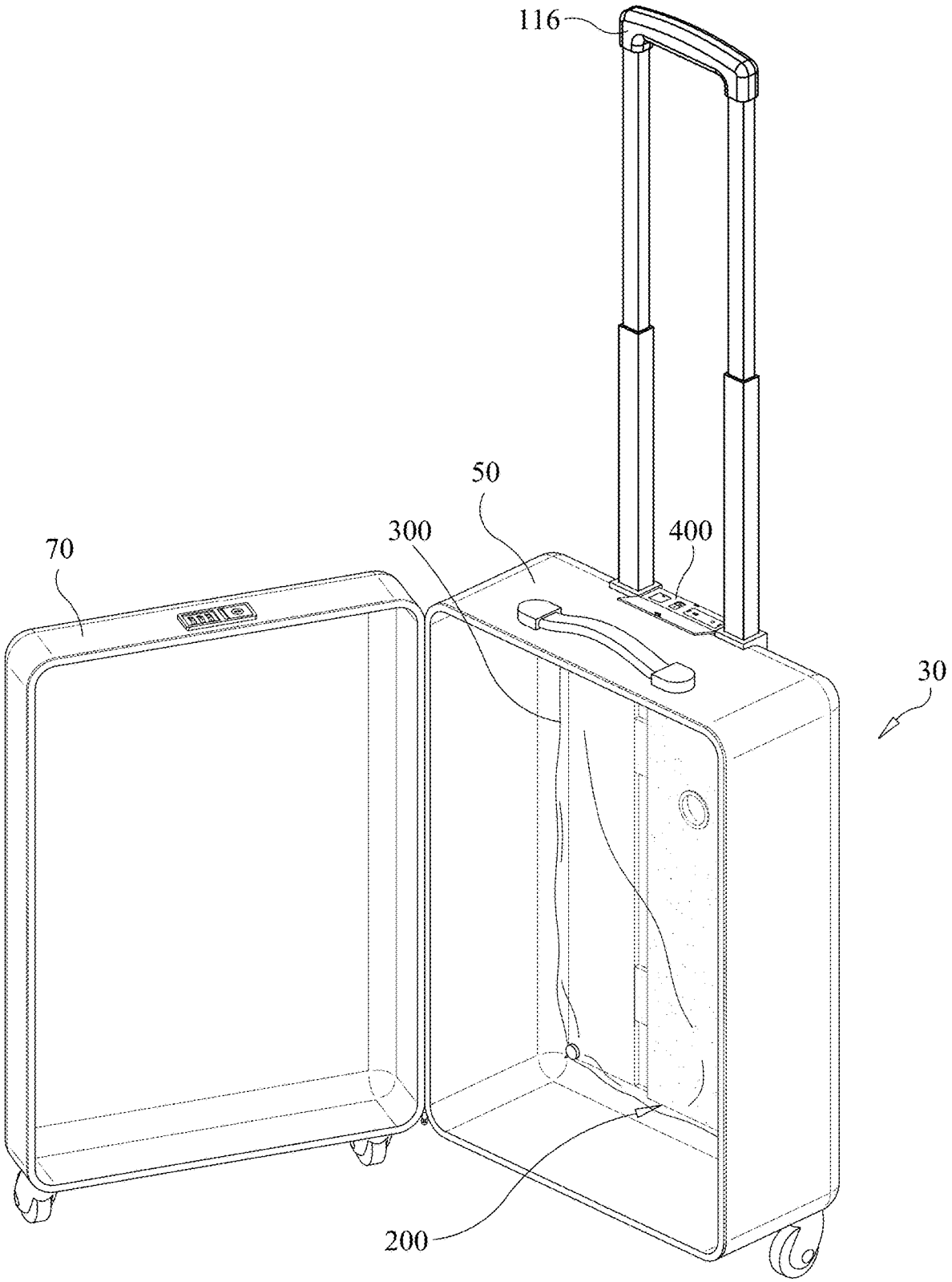
FIG. 1 is a perspective view of a non-limiting embodiment for the novel luggage with integrated compression system in accordance with the present disclosure and with the luggage in an open configuration.

As seen in the drawings, a novel piece of luggage is shown and generally designated as luggage 30. Luggage 30 can include a shell 32 having a sidewall 36 and a backwall 40 that together define an interior space 48. Sidewall 36 can comprise an upper portion 50, lower portion 58, first side portion 60 and second side portion 62. Backwall 40 can have an air exit opening 42 therethrough which is preferably fitted or contains a one-way air flap 44 that opens outward to exhaust or expel air out of luggage 30, as will be discussed in more detail below.

Preferably, the materials and assembly methods used for constructing the shell and front member/panel are conventional and similar to other conventional luggage and such technology, materials and methods are incorporated by reference. However, it is noted, that certain novel modifications are being made to otherwise conventional luggage interior side wall and back wall in connection with the instant disclosure. Modifications examples, include, without limitation, the opening and one-way air valve in back wall 40, battery insertion openings and incorporation of a control panel into the upper wall portion 50 of sidewall 36, compression bag connection assembly, etc. These modifications will be discussed in further detail below.

In one non-limiting embodiment, a single cavity can be provided and the control panel can be incorporated into the housing of a novel vacuum assembly that is preferably disposed within the interior of the luggage between the handle guide tubes that housing the elongated portions of the extendable handle. The vacuum assembly also contains a cavity for receiving the removable/insertable battery 230. Thus, when the vacuum housing is properly disposed within the interior of the luggage, the control panel is properly aligned and disposed within a portion of the opening in wall portion 50 and the remaining portion of the opening can be used for inserting and removing the battery, with the remaining opening portion aligned with the battery receiving cavity in the vacuum housing.

In an alternative embodiment, upper wall portion 50 is provided with a first cavity or opening which receives a control panel that will be discussed further below, which is permanently contained therein. A preferably adjacent opening 52 is also provided or defined in upper wall portion 50 for insertion and removal of a battery member 230 even while luggage 30 is in a fully closed position. A battery receiving cavity can be provided as part of the housing for the vacuum assembly and serves as the final destination for the battery when it is inserted through opening 52 in wall portion 50 The purpose and description of the preferred battery 230 will also be discussed further below.

Figure 12:
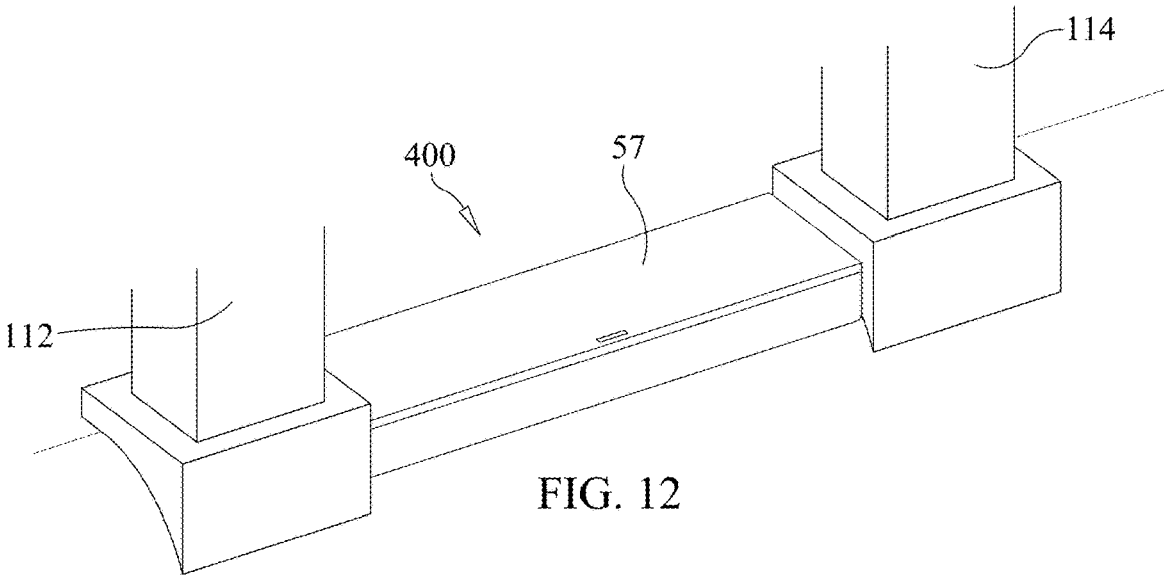
FIGS. 12 is a perspective view of the control panel and battery insertion area in a flap/cover down configuration in accordance with the present disclosure.
Figure 13:
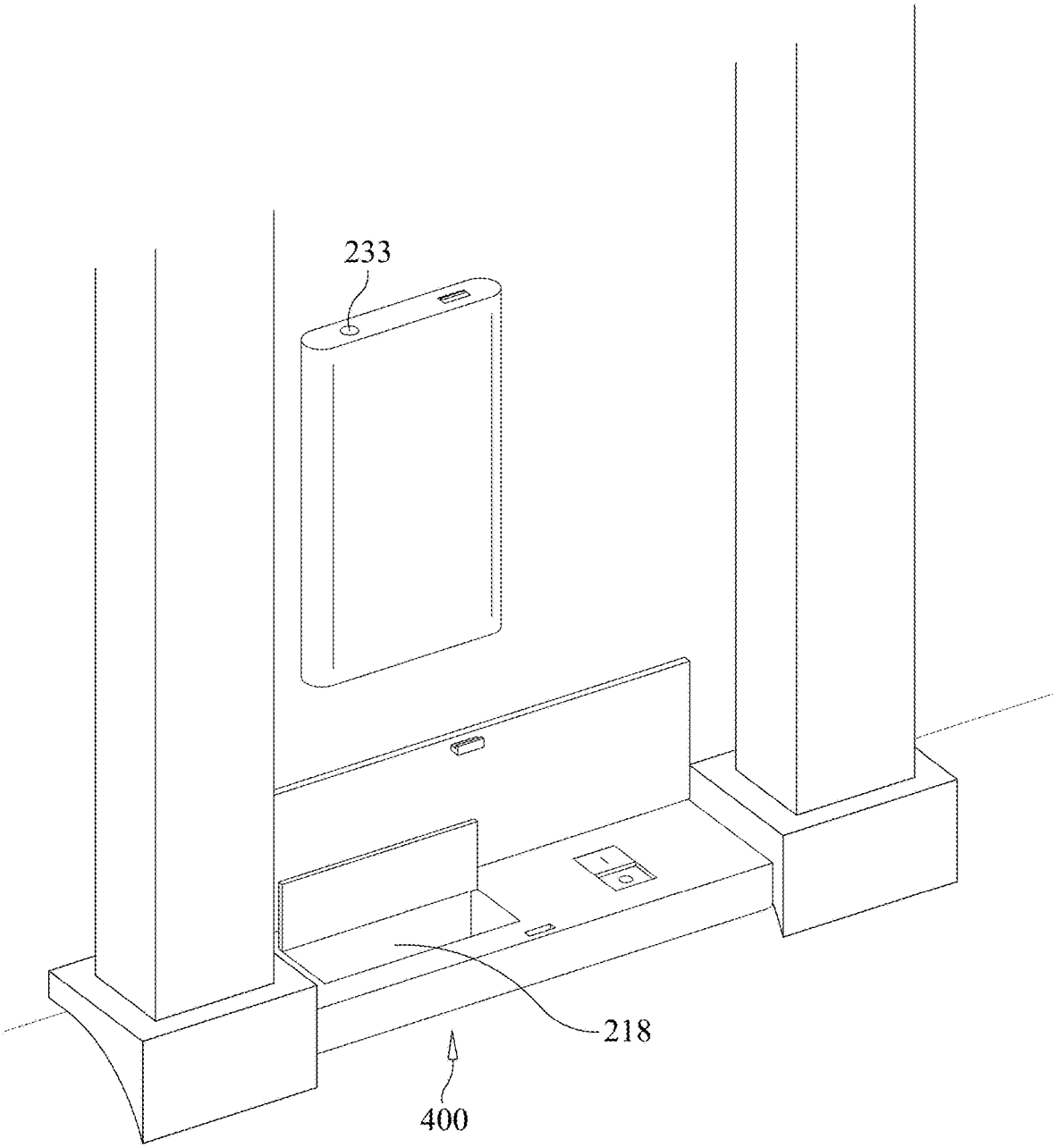
FIG. 13 is a perspective view of the preferred embodiment for the control battery and battery insertion area and showing the battery being inserted in accordance with the present disclosure.
Figure 14:
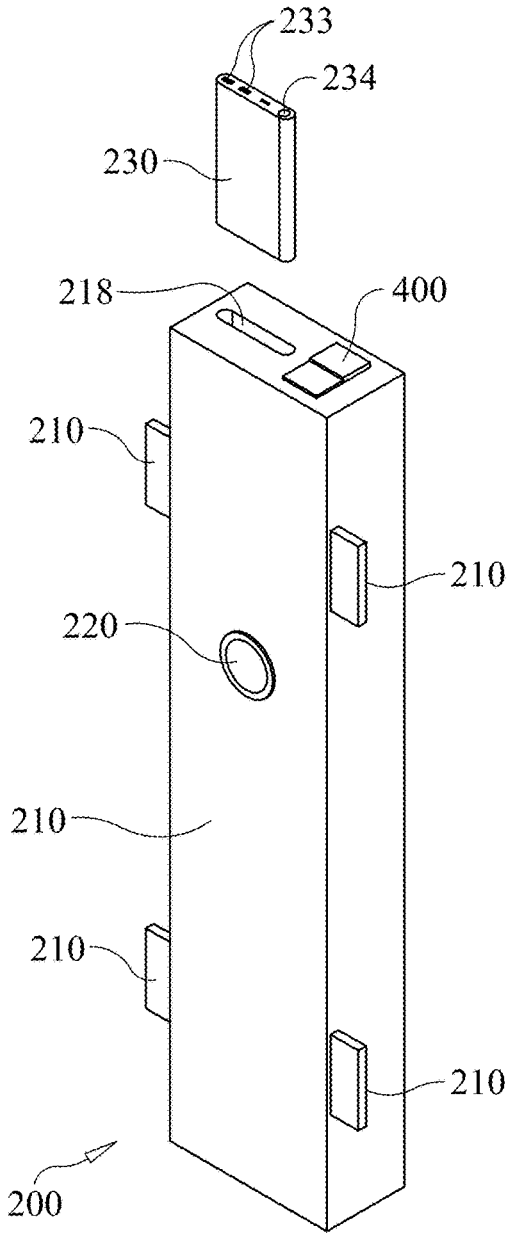
FIG. 14 is a front perspective view of the preferred non-limiting vacuum assembly in accordance with the present disclosure.
Figure 15:
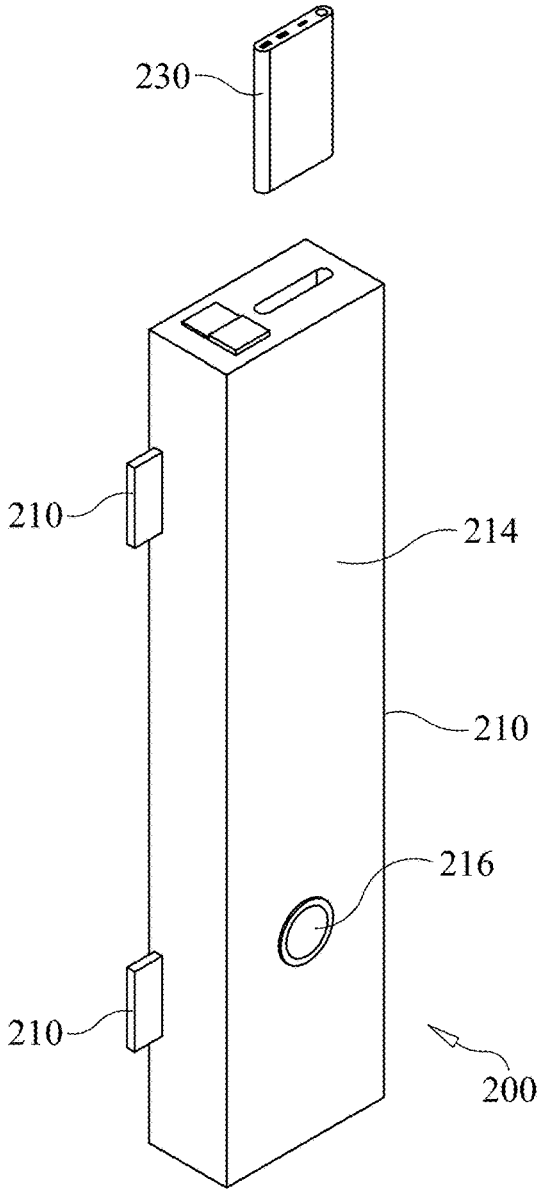
FIG. 15 is a back-perspective view of the preferred non-limiting vacuum assembly in accordance with the present disclosure.
Figure 16:
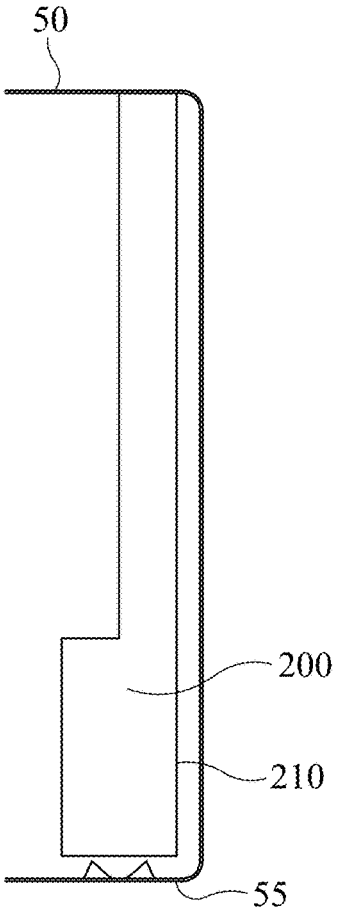
FIG. 16 is a side view of a non-limiting housing configuration for the vacuum assembly in accordance with the present disclosure.

Preferably, a pivotable or rotatable flap member 57 can be connected upper portion 50 adjacent the opening, control panel, inserted battery, cavity, etc. and when in a closed configuration can serve as a waterproof seal or cover to help prevent or reduce the chance of the control panel, battery or other electronics from being exposed to water, fluids, mist, etc. (See FIG. 12)

A front member or panel 70, which is also preferably similar or the same as front members and panels used with conventional luggage is also provided. As is also considered conventional, front member 70 can be provided with outer pockets and is preferably permanently secured to a portion of an edge 34 of shell 32 preferably the portion associated with first side portion 60 of sidewall 36. The remaining edges are removably or releasably secured to the remaining portions of edge 34 preferably by a zipper assembly 80. Preferably a waterproof zipper assembly 80 is provided, such as, those manufactured and offered by YKK Group. However, other sources of waterproof zipper assemblies can also be used and are considered within the scope of the disclosure. Though not preferred, it is also within the scope of the disclosure to use a non-waterproof zipper assembly. As seen, the zipper assembly can include a first set of zipper teeth 82 along the remaining portion of sidewall edge 34 and corresponding zipper teeth 84 along edge portions of front member 70. A zipper pull 86 is connected to both teeth 82 and 84 and is pulled one-way direction or the opposite direction, as conventionally known, to either open or close luggage 30.

Figure 2:
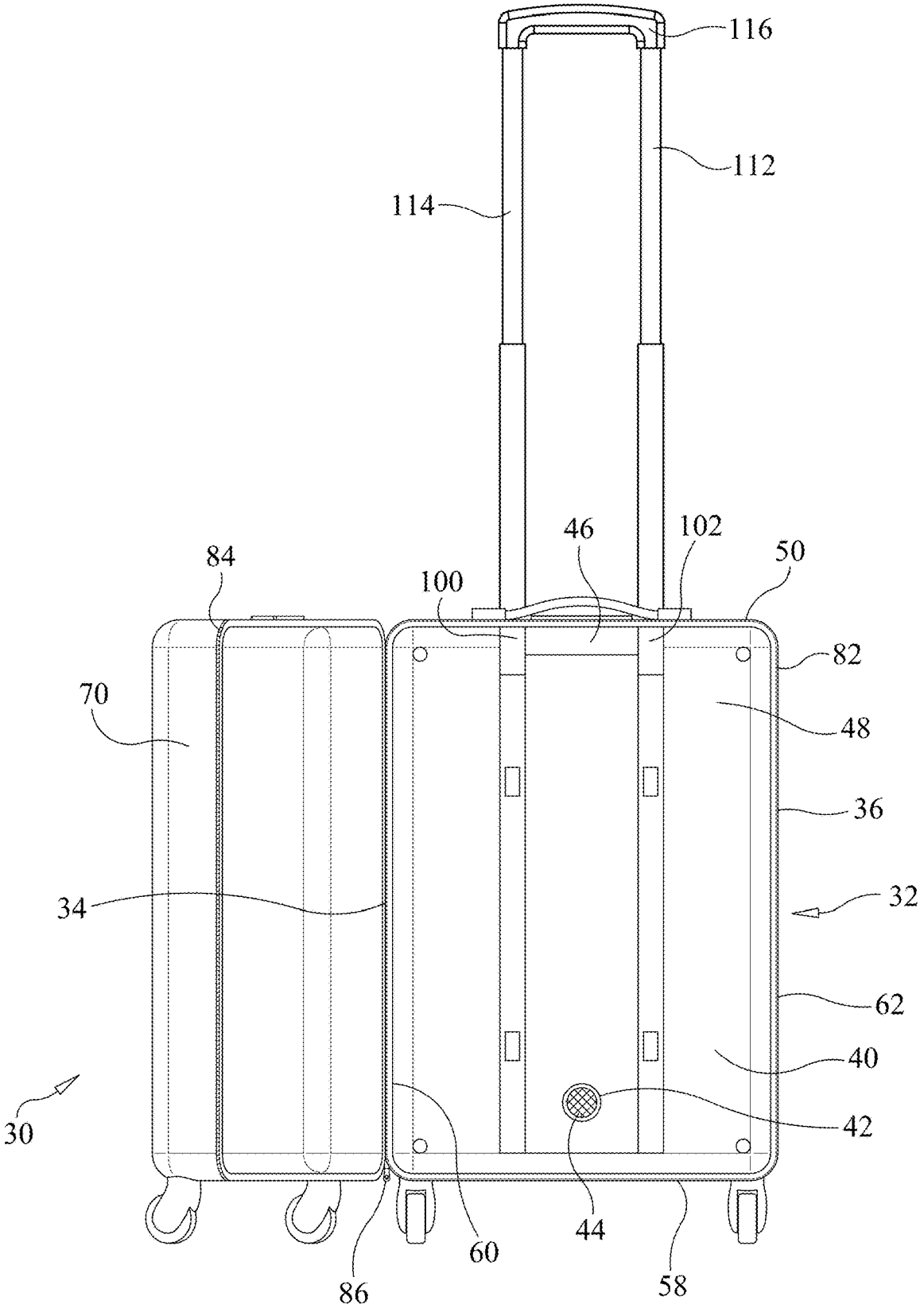
FIG. 2 is a front view of the non-limiting luggage embodiment of FIG. 1 with the vacuum assembly and compression bag removed in accordance with the present disclosure and with the luggage in an open configuration.

As seen in FIG. 2, as well as other Figures, conventional interior handle guide tube or housings 100 and 102 are disposed along or otherwise secured to or associated with an interior surface 46 of backwall 40 similar to conventional luggage with extendable/retractable handles. Preferably, tubes 100 and 102 can run from lower portion 58 to upper portion 50, though such is not considered limiting. Tubes 100 and 102 are provided for receiving corresponding elongated members 112 and 114 of a handle member 110, as handle member can be telescoping in nature similar to conventional handles on luggage. The outer ends (the ends opposite of a cross member 116 of handle 110) of elongated member 112 and 114 are contained within tubes 100 and 102 and conventional stop members can be provided at the outer ends to prevent handle 110 from being fully out of tubes 100 and 102 when pulling up on handle to extend handle 110 out, as is conventionally known. Cross member 116 is preferably connected at the other end of elongated members 112 and 114, such that handle 110 can form a U-shape. Though not limiting or required, handle 110 can be preferably provided with one or more conventional buttons that can be pressed in order to pull handle 110 outward (extended position) and/or to push handle back down into tubes 112 and 114 (retraced position).

In a preferred embodiment, the size and/or shape of cross member 116 can be selected to allow cross member 116 to fully cover, hide, provide a waterproof seal, and/or protect (along with a sealing member, such as a gasket, O-ring, etc.) the preferably provided control panel and battery that is also positioned at upper portion 50, when handle 110 is a fully retracted position. Where a flap cover 57 is provided for protecting the electronics (See FIG. 12), cross member 116 in its fully retracted position can cover flap cover 57 when flap cover 57 is folded down. Even in the fully retracted position, with elongated members 112 and 114 within corresponding guide tubes 100 and 102, cross member 116 is preferably externally accessible. Handle 110 is preferably movable from a fully retracted position to a fully extended portion with respect to upper wall portion 50 of sidewall 36.

Between guide tubes 100 and 102, along with an associated portion of backwall 40, a space or area 140 is defined as the preferred area for receiving and securing a preferably removable self-contained vacuum assembly 200 in accordance with the present disclosure. However, it is within the scope of the disclosure to locate the vacuum assembly at another spot within luggage 30, which may or may not also cause the location of air exit opening 42 in backwall to be located elsewhere or within a portion of sidewall 36.

As mentioned above, a removable self-contained vacuum assembly 200 can be preferably provided and includes an outer box or housing 210 (collectively "box") that is disposed and removably secured within the interior space and positioned within at least a majority portion of the first area defined between the first handle guide tube 100 and the second handle guide tube 102. Vacuum outer box/housing 210 can be secured, preferably removably and preferably within area 140 between guide tubes 100 and 102 by any one of several connection methods and how housing 210 is secured is not considered limited to any particular type of mechanical connection.

Outer box 210 preferably houses all of the components of the vacuum assembly, including, without limitation, a power source, pump, motor, hoses/conduits, etc. Outer box 210 can be constructed from one or more various types of materials, including, without limitation, metals, plastics, woods, etc.

In one non-limiting connection method, outer box 210 can be provided with corner plates at each corner on or near its back wall 214 for removably/releasably securing box 210 to guide tubes 100 and 102 within the space defined between the tubes within luggage 30. In another non-limiting connection embodiment, backwall 214 of housing 210 can be provided with a mechanical connection member which mates with a corresponding connection member on interior surface 46 and can be released by either pushing on release buttons provided and accessible on housing 210 or by pushing down on housing 210 to cause it to release its connection. It is also within the scope of the disclosure that the design and size of housing 210 can be chosen such that it creates a snug connection with guide tubes 100 and 102 without any other mechanical connection mechanism. As stated above the type and location for securing vacuum assembly 200 within luggage 30 is not considered limited to any specific type of connection and all possible connectors can be used and are considered within the scope of the disclosure.

Outer box back wall 214 is also provided with an air exit opening 216 that preferably includes a male or female connector/coupler for aligning, connecting and creating a preferred sealed connection between opening 216 and a corresponding female or male connector/coupler and opening 42 of backwall 40 of luggage 32. Other connections mechanisms can also be used that preferably allow the air removed from the compression bag and pulled/sucked within outer box 210 and out through exit opening 216 to continue through opening 42 of shell backwall 40 and into the atmosphere as opposed to escaping through exit opening 216 and still remain within the inside the luggage 30. Additionally, the air exit opening, when provided, can be located at other areas (i.e. sidewalls, other areas on back wall, etc.) in addition to the location shown in the drawings for opening 216.

Outer box 210 can have a front wall 218 that can be provided with an opening 220 for receiving the drawn in air from the vacuum/compression bag 300 when the pump of self-contained vacuum assembly 200 is operated. Preferably, a back opening in the vacuum/compression bag can be aligned, connected and sealed with front box opening 220 so that the withdrawn air travels into housing 210 and does not remain or escape inside luggage 30. Though not required the compression bag attachment to box/housing 210 can be similar to the attachment of box/housing 210 with backwall 40 of the shell or another securement method or mechanism can be used and are also considered within the scope of the disclosure. The vacuum assembly can also be provided with any other conventional components that are common with vacuums for withdrawing air from a compression bag and all of such components are incorporated by referenced and considered as part of the instant disclosure and preferably these additional components can also be disposed and hidden within outer box/housing 210.

Preferably, the power source is a removable battery 230 that is also preferably removable while luggage 30 is in a "closed" configuration by allowing battery 230 to be externally accessible and withdrawn through a designated opening in upper wall portion 50 of sidewall 36. Box/housing 210 can be provided with a side opening/cavity for receipt of battery 230 and can securely, yet releasably, contain and secure battery 230 in place even if luggage 30 is held upside down and preferably even with flap cover 57 in an open position. Battery 230 can be provided with one or more, and preferably two, buttons 234 on an exposed outer surface which when pressed by a user causes battery 230 to be released from its locked securement configuration within the outer box cavity and battery 230 can then be removed through designated opening 51 without opening luggage 30. Battery 230 can also be easily reinserted within outer box cavity through opening 51 and preferably snaps in place within the cavity to again securely lock battery 230. When properly secured, battery 230 makes electrical contact with the electronic/electrical components of vacuum assembly 200 to provide power for operating the vacuum. Similarly, battery 230 can also be in electrical contact with a control panel 250 also disposed within upper portion 50 for providing power to the electrical components of control panel 250. Battery 230 can be preferably provided with one or more electrical ports, such as USB ports 233 to allow battery 230 to also charge other electrical device while battery 230 is secured within the outer box cavity or while battery 230 is removed from the cavity. Thus, in a preferred embodiment, when luggage 30 is in a fully closed configuration, battery 230 can still be removed and inserted within the receiving cavity of housing 210 through opening 51 of top portion 50.

An additional, preferably USB port 235 can also be provided with battery 230 and can be preferably used for recharging or charging battery 230. In the preferred embodiment, port 235 can be a mini USB or micro USB port for connection of a conventional corresponding USB cord that will plug in at one end to port 235 and at the other to a power/energy source (i.e. charging station at an airport or elsewhere, USB port on a computer or other electrical device, etc.). Other USB type ports can also be used as an alternative to the mini USB or micro USB port and are also considered within the scope of the disclosure.

Figure 21:
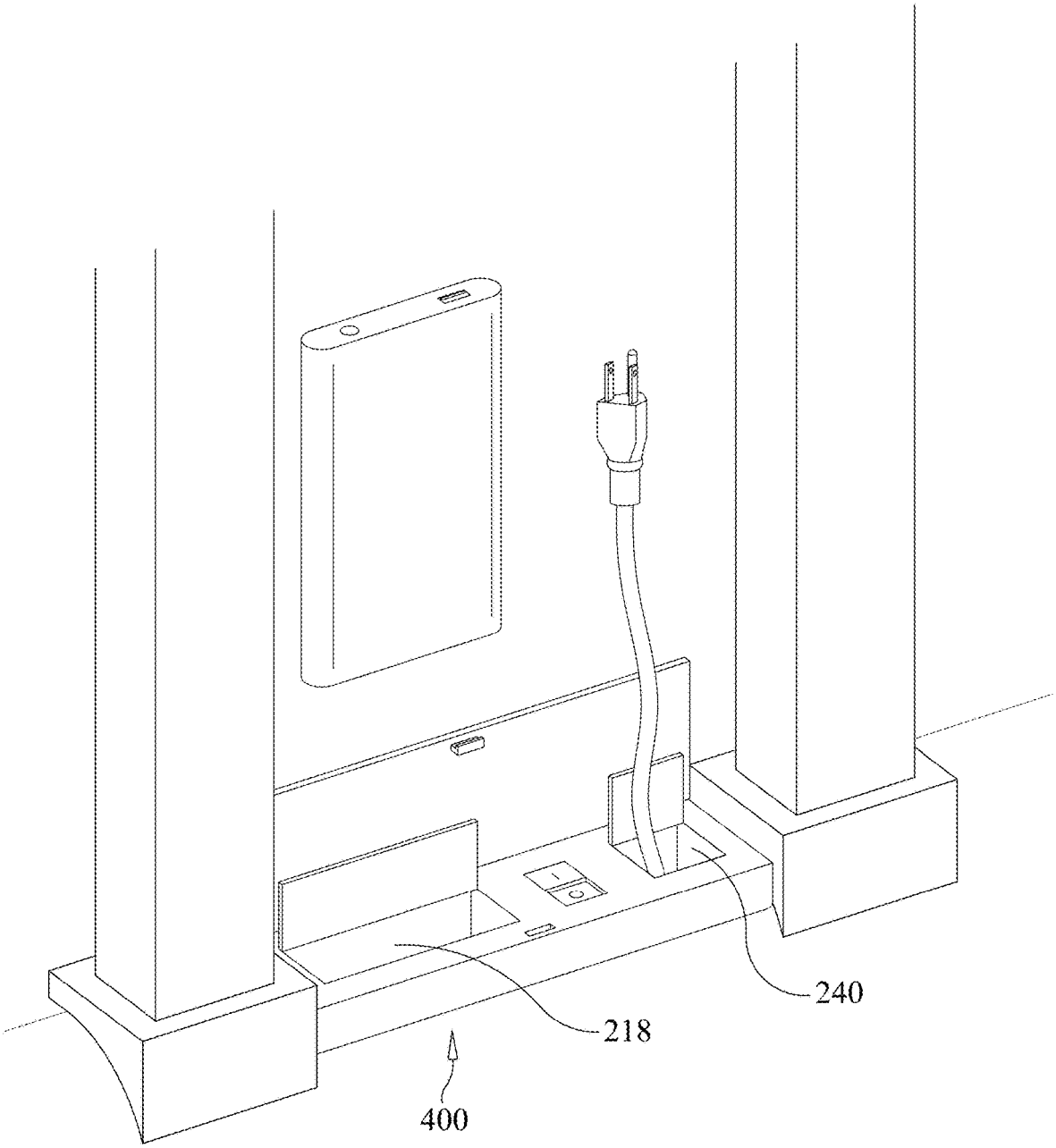
FIG. 21 is a perspective view of an alternative embodiment for the control panel and battery insertion area, along with an optional AC cord, in accordance with the present disclosure and in a flap/cover up configuration.

In addition to port 235 or in lieu of port 235, an AC cord (two or three prong and preferably retractable) can be provided (See FIG. 21) and used for recharging battery 230, by plugging the AC cord into a conventional AC outlet. The electronics can be also be configured that the vacuum can be turned on and operated when a USB cord is plugged into port 235 and a power source or the AC cord is plugged into an outlet (even if battery 230 is not sufficiently charged). The various electronic components ports, circuitry, on/off switch, battery contacts can be in electrical communication or connection with each other through conventional electrical or electronic components. Where no AC cord is provided, area 240 can be used as a storage compartment for relatively small items (i.e. ear bud, charging cable, etc.) and could have a bottom surface to retain any stored items with the compartment.

Preferably disposed completely within vacuum housing 210 can be an air entry conduit that receives the air drawn in from compression bag 300 through opening 220 by a conventional pump assembly which is also preferably disposed completely within vacuum housing 210. An air exit conduit is also preferably completely disposed within the outer box or housing 210 and receives and delivers the air drawn in by the pump out of luggage 30 through opening 216 and luggage backwall opening 42. Thus, the air exit conduit can be preferably aligned with and preferably sealably or mechanically connected to back opening 216 of box 210. Back opening 216 can be aligned with and preferably sealably or mechanically connected with opening 42 of back wall 40 when the vacuum assembly 200 is properly disposed within interior space 140 and positioned between handle guide tube 100 and handle guide tube 102. Thus, air withdrawn from compression bag 300 can be allowed to travel through the air exit conduit to exit out of outer box/housing 210 and out of luggage 30 and into the atmosphere. Similarly, the air entry conduit is aligned with front opening 220 of outer box or housing 210.

As will discussed in more detail below, a control panel 400 can be provided with an on/off button 204 for operating vacuum assembly 200. Control panel 400 can be preferably disposed within upper wall portion 50 of shell and is provided with circuitry/electronics that is in electrical contact with battery 230 and the retractable AC cord 450 (where provided in certain alternative embodiments). Though preferably provided with battery 230, preferably one or more externally accessible ports in electrical communication or contact with the battery can also be provided in control panel 400. As mentioned above, control panel and battery 230 are both preferably covered up and hidden by flap cover 57 (when in a closed/down position), and can also be further covered by handle 110, when handle 110 is also in a down or retracted position.

Figure 5:
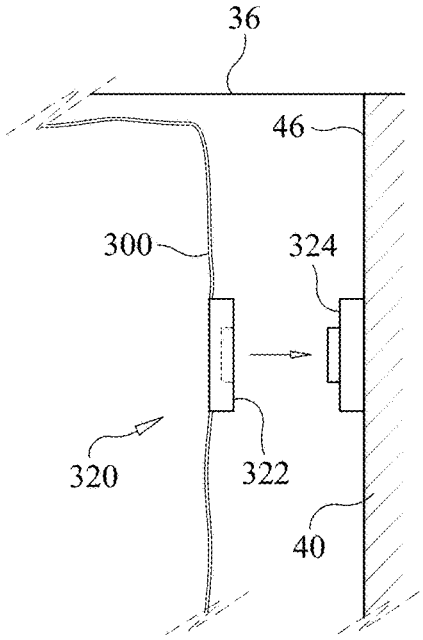
FIG. 5 is a close-up view of a non-limiting securement embodiment for securing the compression bag within the novel luggage in accordance with the present disclosure.
Figure 6:
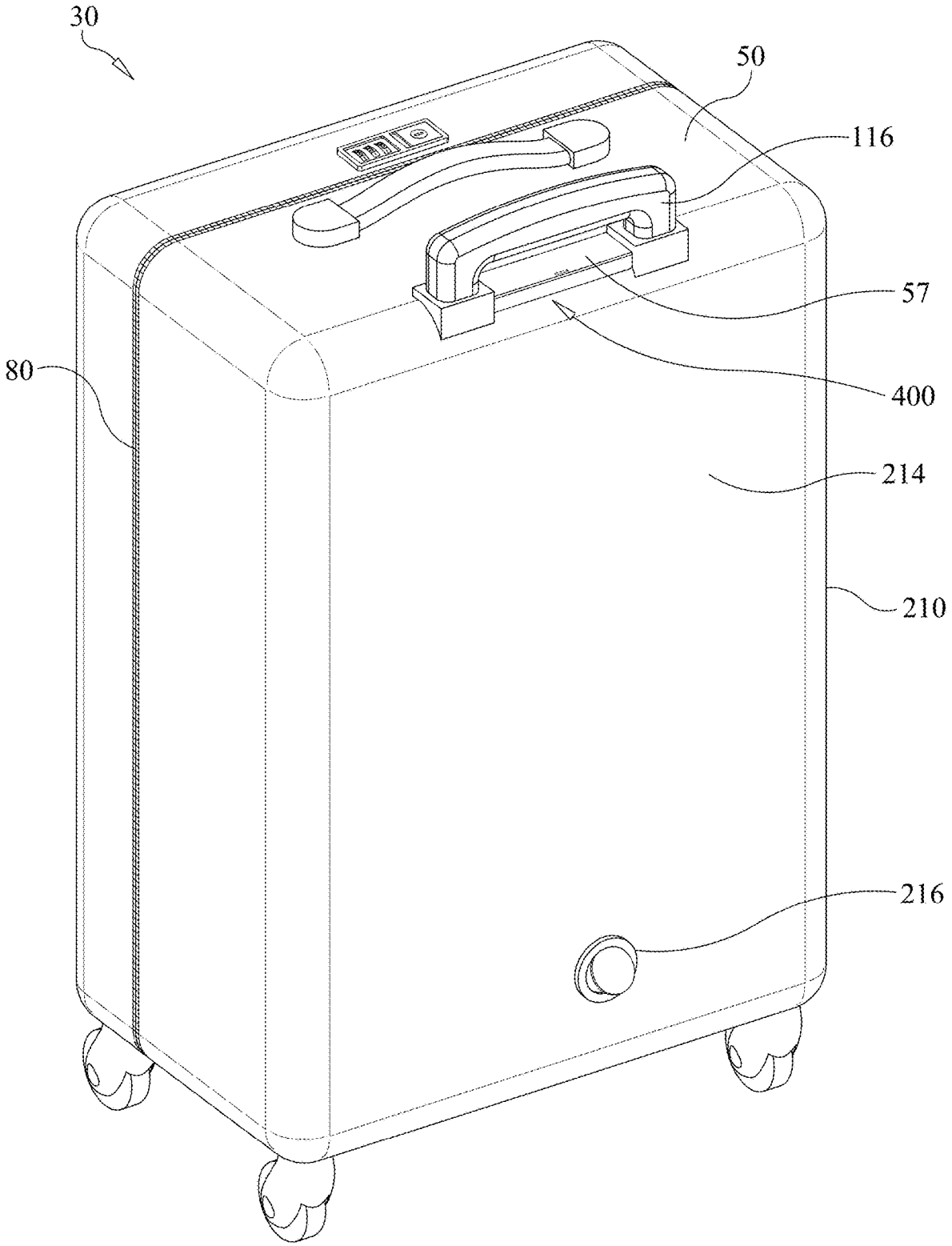
FIG. 6 is a back-perspective view of the non-limiting luggage embodiment of FIG. 1 in accordance with the present disclosure and with the luggage in a closed configuration.

Compression bag 300 can operate similar (sealable or closable top opening for inserting clothes and/or other contents into bag 300) to a conventional vacuum compression bag and can be constructed from materials known for manufacturing conventional vacuum/compression bags. In addition to the connection of a back portion of bag 300 with vacuum housing 210 for aligning the openings to remove the air from bag 300, compression bag can also be secured to one or more locations within the interior of luggage 30. Though not considered limiting, the securement can be a releasable or removable securement connection, such as a plurality (e.g. 4, etc.) of mating snap connection 320 (See FIG. 5). In one non-limiting embodiment, a first male or female member 324 can be provided in or near each bottom corner of shell 32 for mating with a corresponding opposite male or female member 322 secured to compression bag 300. Preferably, the securement members are secured on a designated bottom area of bag 300 so as to not restrict the expansion of bag 300 for receiving content prior to the removal of the air from within bag 300 by vacuum assembly 200. Other securement mechanism, in lieu of a snap connector, can be used and all are considered within the scope of the disclosure.

Figure 19:
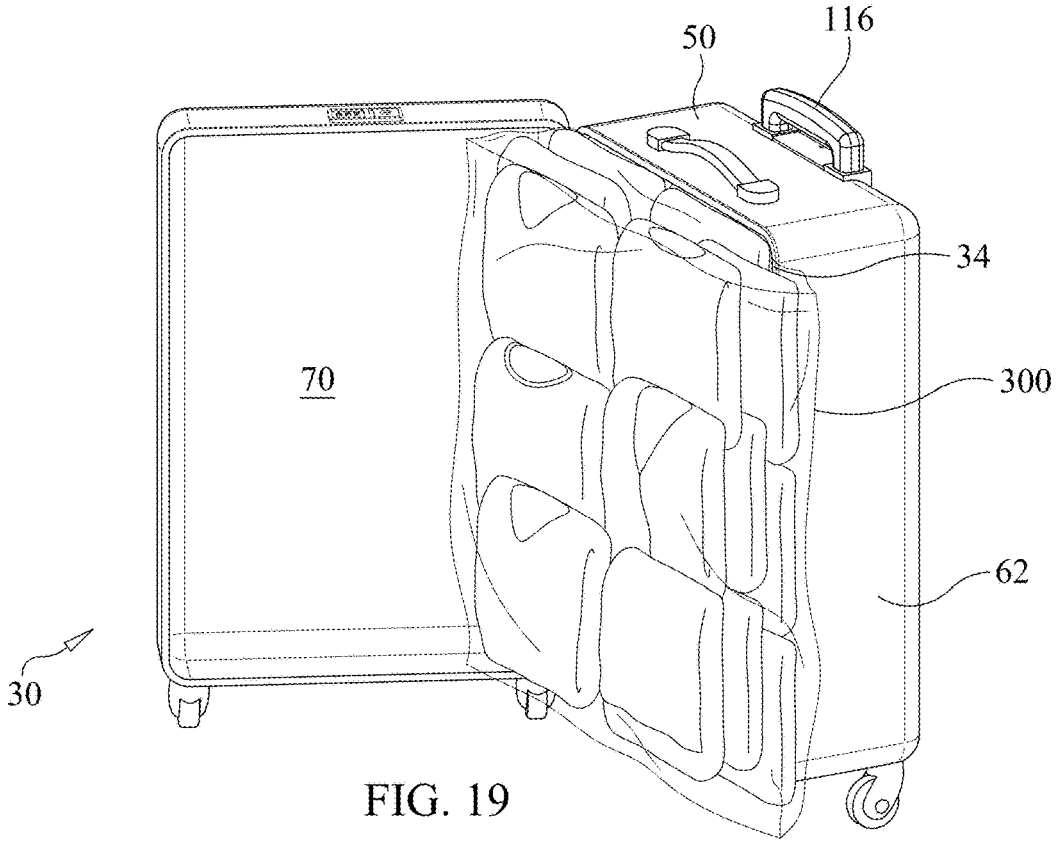
FIG. 19 is a perspective view of the novel luggage with compression bag filled with content that extends over the edge of the luggage and prior to compression.
Figure 20:
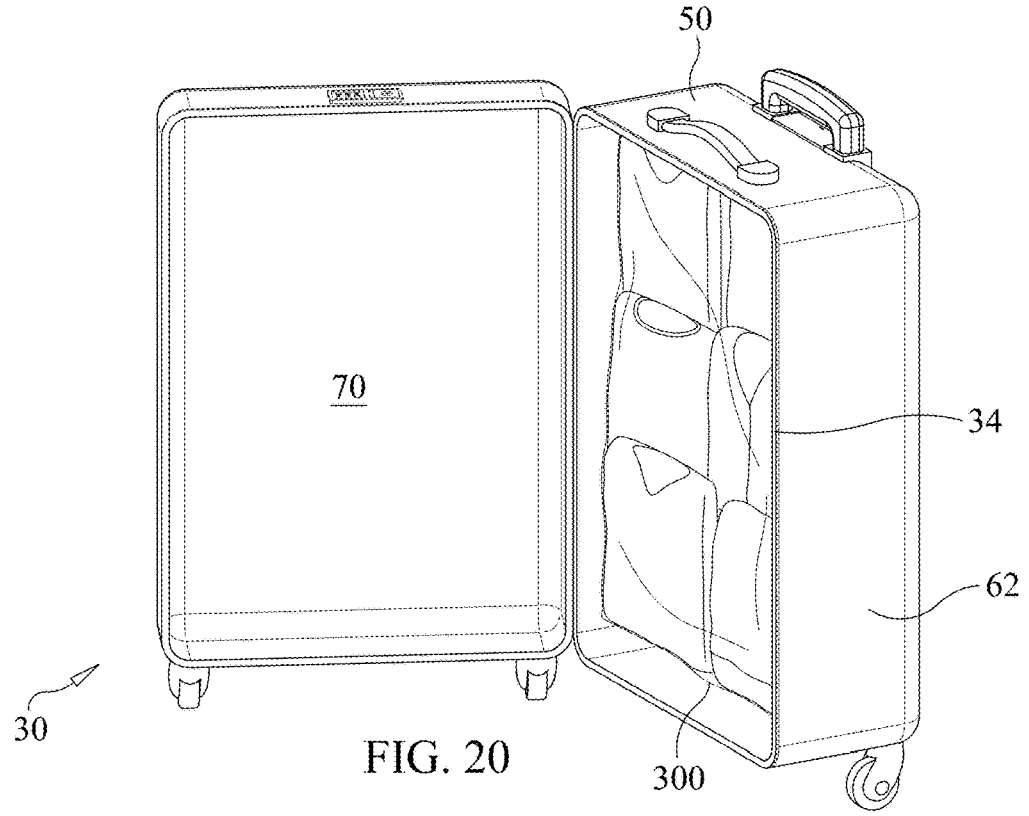
FIG. 20 is a perspective view of the novel luggage with the same compression bag and content of FIG. 19 and all fitting within the dimensions of the luggage after compression of the bag and contents by the integrated vacuum assembly in accordance with the present disclosure.

As seen in FIG. 19, prior to removing the air from within bag 300 through provided vacuum assembly 200, bag 300 can be preferably larger in size that the dimensions of luggage 30 such that bag 300 extends over the edges of sidewall 36. However, once the air is withdrawn from within bag 300 by vacuum assembly, bag 300 along with its contents completely fits within interior space defined by luggage 30 (See FIG. 20) and, thus, allowing more content (i.e. clothing, etc.) to be contained within luggage than typically provided by a similar sized piece of luggage not having a compression bag incorporated therein. Therefore, a user can pack more clothing in the luggage space as compared to a same size luggage not having a compression bag/vacuum functionality.

Figure 22:
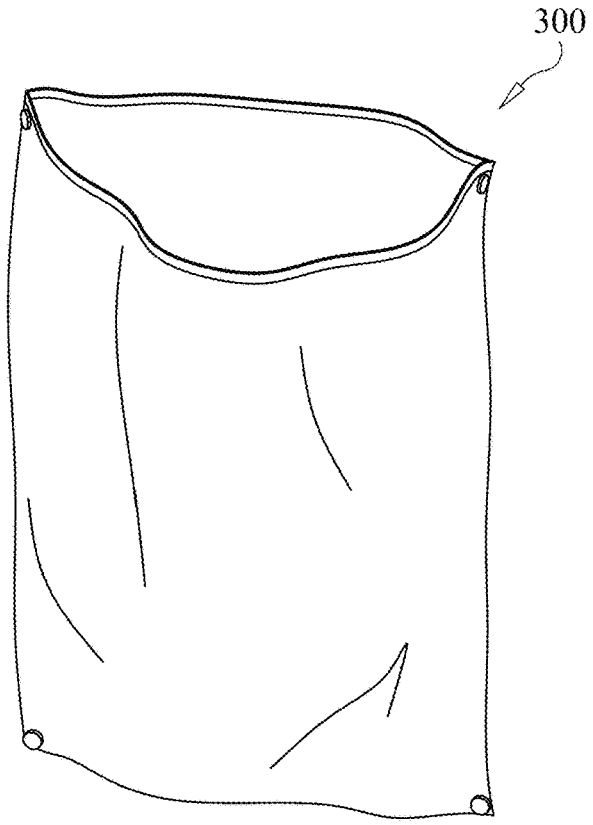
FIGS. 22 is a perspective view of a non-limiting embodiment for the compression bag shown in an open configuration in accordance with the present disclosure.
Figure 23:
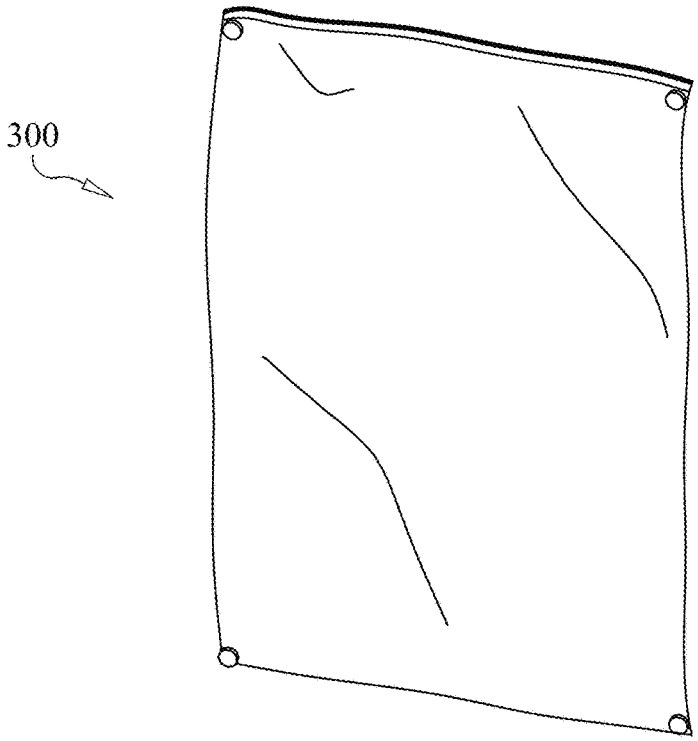
FIG. 23 is a perspective view of the compression bag of FIG. 22 shown in a sealed configuration in accordance with the present disclosure.

Accordingly, in use and with luggage 30 in a fully closed configuration, compressed bag 300 and its contents are stored and secured within the interior space of luggage 30. When luggage 30 is in an open configuration and bag 300 is in an uncompressed state, compression bag 300 extends beyond the interior space within the shell and preferably over the outer or upper edge of sidewall 36. Preferably, a clothes, items or other content insertion opening is provided at a top portion of compression bag 300 (see FIG. 22), though it is also within the scope of the disclosure to also provide this opening at another area (i.e. front, etc.) of bag 300. Preferably, the opening is sealable or otherwise closeable when vacuum assembly 200 is in use in order to allow the air within bag 300 to be withdrawn through the back opening in bag 300 (See FIG. 23). The back opening in bag 300 can serve as an exhaust port and can be preferably aligned with the front opening 220 of vacuum housing 210 such that the air within bag 300 is withdrawn into housing 210 and into the air entry conduit by vacuum assembly 200.

Thus, as shown in the drawings and discussed above, luggage 30 can be preferably provided with an integrated compression system where at least one vacuum compression bag 300 can be provided and secured within the interior space of luggage 30. Bag 300 can be compressed by an attachment within the interior of luggage 30. A vacuum assembly 200 draws air from bag 300 out of luggage 30 preferably through an opening in a back wall of luggage 30 which can serve as an exhaust port. Preferably, the back wall opening is provided with a one-way air valve that opens outward when air is being withdrawn and seals the back wall opening otherwise to prevent air from entering luggage 30 through the back wall opening. Any conduits or hoses used by the vacuum can be preferably hidden within the vacuum housing 210 and are not seen nor do they interfere with the use conventional use of luggage 30 for storing and carrying clothes and other items. Preferably, vacuum assembly 200 is disposed between the conventional unused space between handle guide tubes 100 and 102 that guide and direct the movement of the two elongated members of the luggage handle. Preferably, vacuum assembly 200 can be flush with tubes 100 and 102 and can be removably secured within this space, such that it can be removed if not needed. A removably battery 230 can also be provided for powering vacuum assembly 200 and any other electrical or electronic components provided with luggage 30. Preferably, battery 230 can be removed and inserted in place through a top portion 50 of sidewall 36 such that it can be removed and inserted within having to open up luggage 30. In a preferred, yet non-limiting embodiment, battery 230 can be a removable lithium ion battery. A control panel 400 can also be provided at top portion 50. Preferably, when the handle of luggage 30 is in a fully closed position battery 230 and control panel 400 can be fully covered and a waterproof seal can be created to protect battery 230 or panel 400 from water damage (i.e. rain, etc.)

The electrical circuitry and components for operating the vacuum assembly and recharging the battery are not considered limited to any specific schematic or configuration and the electrical/electronic design can be achieved in various designs and all are considered within the scope of the disclosure.

Preferably, shell 32 of luggage 30 can be made from a hard-rigid material such as, but not limited to, those use for conventional luggage. Luggage 30 can also have wheels or castors, such as four wheels, that can be similar or the same as current wheels used for conventional luggage. Wheel guards can also be provided.

The novel luggage 30 serves as a "smart" luggage and preferably includes removable battery 230 and removable/detachable vacuum assembly 200, in order to reduce the total weight of luggage 30 such as when need to comply with airline and/or Federal/International weight regulations. The disclosed novel luggage provides the user the ability to also compress while "on the go" such as when the user is away from a power source or access to a vacuum. The mounting of vacuum assembly 230, charging ports and battery 230 within the typically unused area between the handle guides allows the normal full clothes/items space of the luggage to still be available to the user for storing his or her contents, and with the additional of compression bag 300, virtually maximum storage space within luggage 30 is provided.

When vacuum assembly 200 is removed detached, a seal can be provided at the back opening of compression bag 300, such that bag 300 can remain in a compressed state to continue to allow more items to be contained within luggage 30 than similarly sized conventional luggage.

Preferably, luggage 30 is waterproof with all areas of luggage 30 that can be opened preferably provided with waterproof connections or seals. Bags 300 are vacuumed by vacuum assembly 200. Clothing can be packed inside compression bag 300, and preferably, up to at least double the original size of the suitcase, and then compressed using vacuum assembly 200 such that bag 300 and its contents can be stored within luggage 30 when luggage 30 is in a fully closed configuration. When unpacking or to re-inflate bag 300 is simply opened as is conventionally known, which allows air to fill bag 300 and also causes the packed clothing to return to their original size and form.

Figure 17:
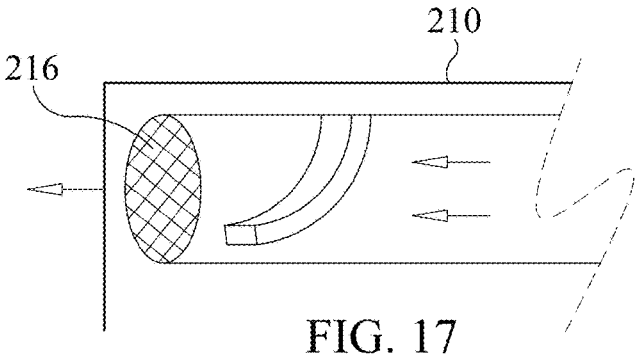
FIG. 17 is a partial sectional view of the vacuum assembly showing the hidden/internal air exit conduit having an optional one-way valve and air flowing out.
Figure 18:
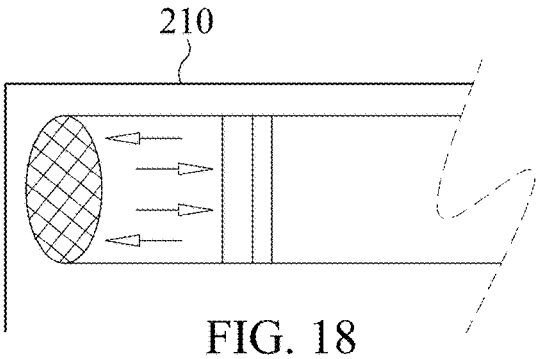
FIG. 18 is a partial section view of the vacuum assembly showing the hidden/internal air exit conduit with the optional one-way valve blocking air from returning any further into the vacuum housing and luggage.

As seen in FIGS. 17 and 18, as an alternative to have the one-way flap associated with the opening in back surface of shell 32, the one-way valve can also be incorporated within the air exit conduit disposed within vacuum outer housing 210.

Figure 7:
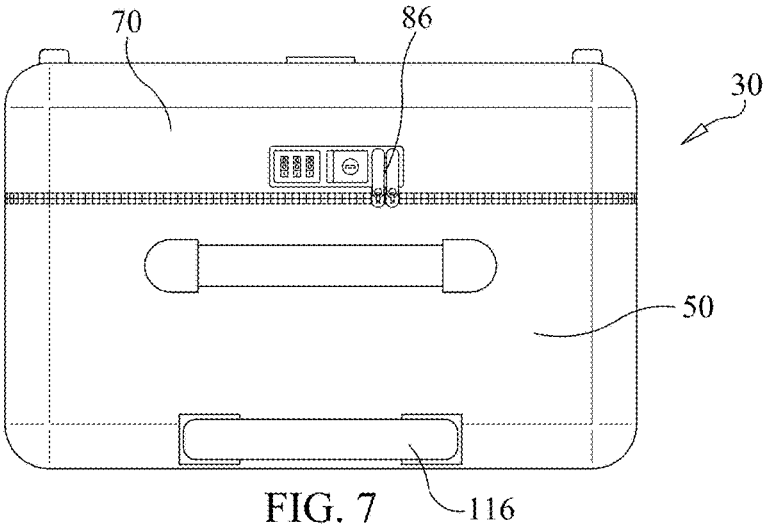
FIG. 7 is a top view of the non-limiting luggage embodiment of FIG. 1 in accordance with the present disclosure.
Figure 8:
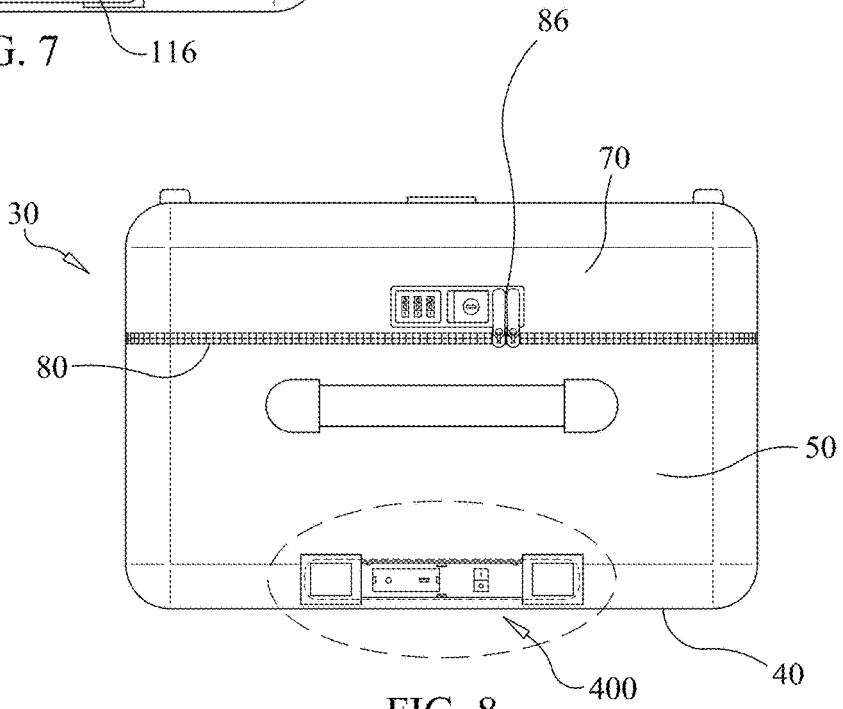
FIG. 8 is a top view of the non-limiting luggage embodiment of FIG. 1 with a portion of the handle removed to show the control panel, battery and/or other components in accordance with present disclosure.
Figure 9:
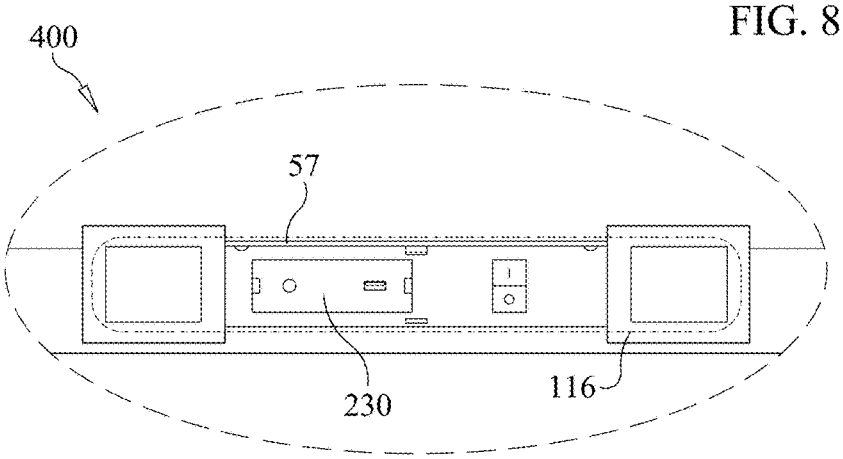
FIG. 9 is a close-up top view of the control panel area of the novel luggage shown in FIG. 8.
Figure 10:
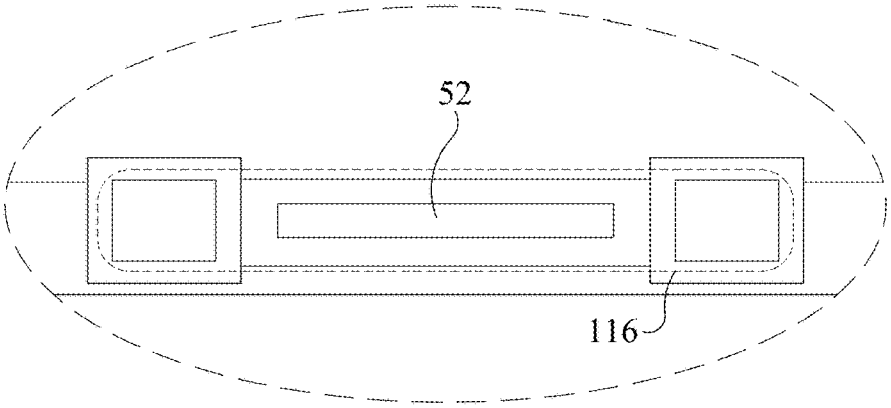
FIG. 10 is a close-up alternative view for a top section of the novel luggage and shown an alternative cavity for receiving the battery in accordance with the present disclosure.
Figure 11:
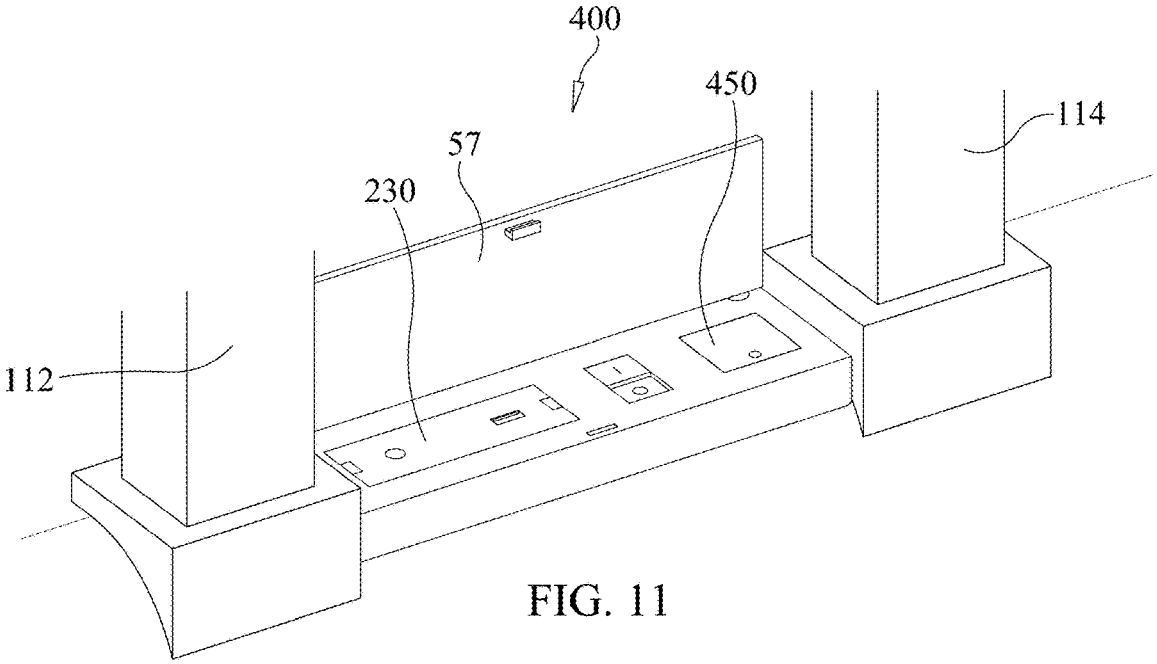
FIG. 11 is a perspective view of a preferred embodiment for the control panel and battery insertion area in accordance with the present disclosure and in a flap/cover up configuration.

Luggage 30 can also be provided with Travel Sentry locks which in conjunction with the zipper pulls are used to lock luggage 30 when in a closed configuration (See FIG. 7). The construction and operation of conventional Travel Sentry locks are known and are incorporated by reference.

Thus, novel luggage 30 increases the amount of clothes, shoes, accessories, toiletries and other items, one can pack. Its preferred waterproof design (e.g. hard sided waterproof shell, waterproof zipper, compression bag, etc.) also aides in keeping the contents within luggage 30 dry. Novel luggage 30 also provides the ability to charge other electronic devices, such as, but not limited to USB compatible devices and can also recharge and remove battery 230 thus making luggage 30 self-sufficient.

In at least certain luggage embodiments, the internal cavity of the luggage/suitcase can have an area or portion reserved to fit and/or house the pump component. A portion or area of the internal cavity can also be reserved for fitting and/or housing the power pack or other power source/power module.

The following modifications will be implemented on the final design of the suitcase. The internal cavity of the suitcase will reserve an area to fit the pump. The internal cavity of the suitcase will reserve and area for the power pack.

Figure 3:
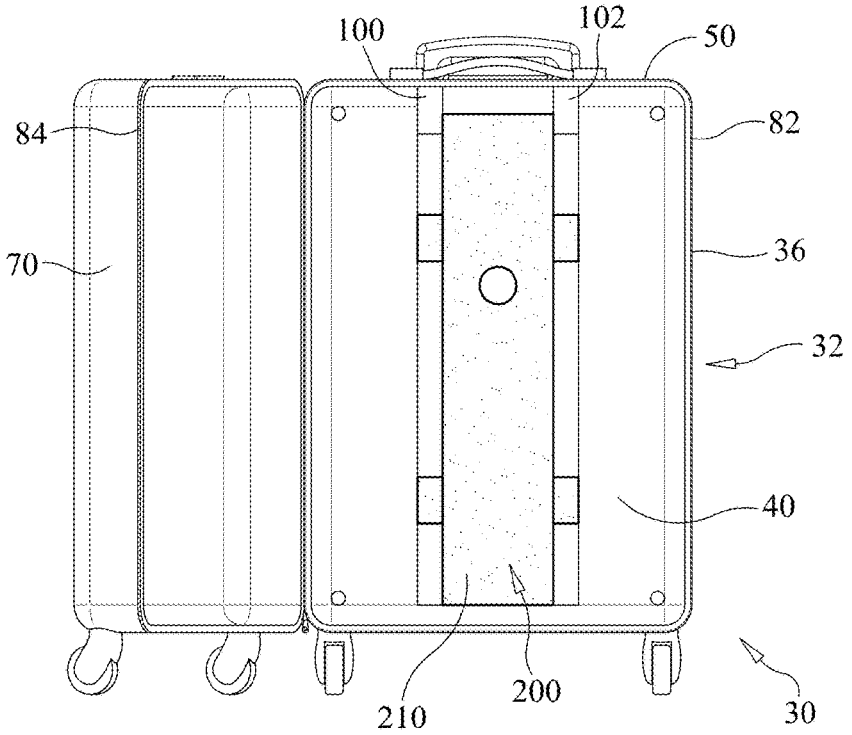
FIG. 3 is a front view of the non-limiting luggage embodiment of FIG. 1 with the compression bag removed in accordance with the present disclosure and with the luggage in an open configuration.
Figure 4:
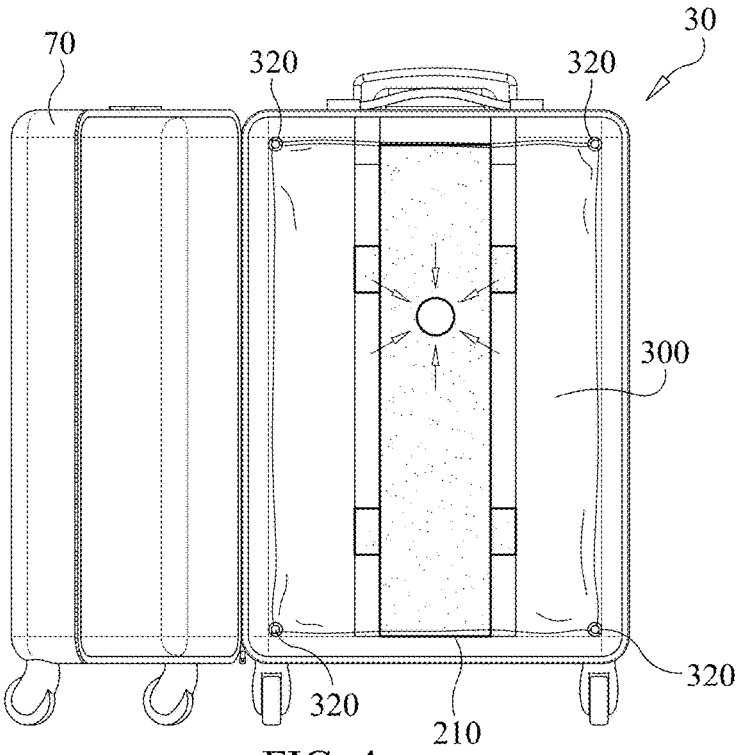
FIG. 4 is a front view of the non-limiting luggage embodiment of FIG. 1 in accordance with the present disclosure and with the luggage in an open configuration.
Figure 24:
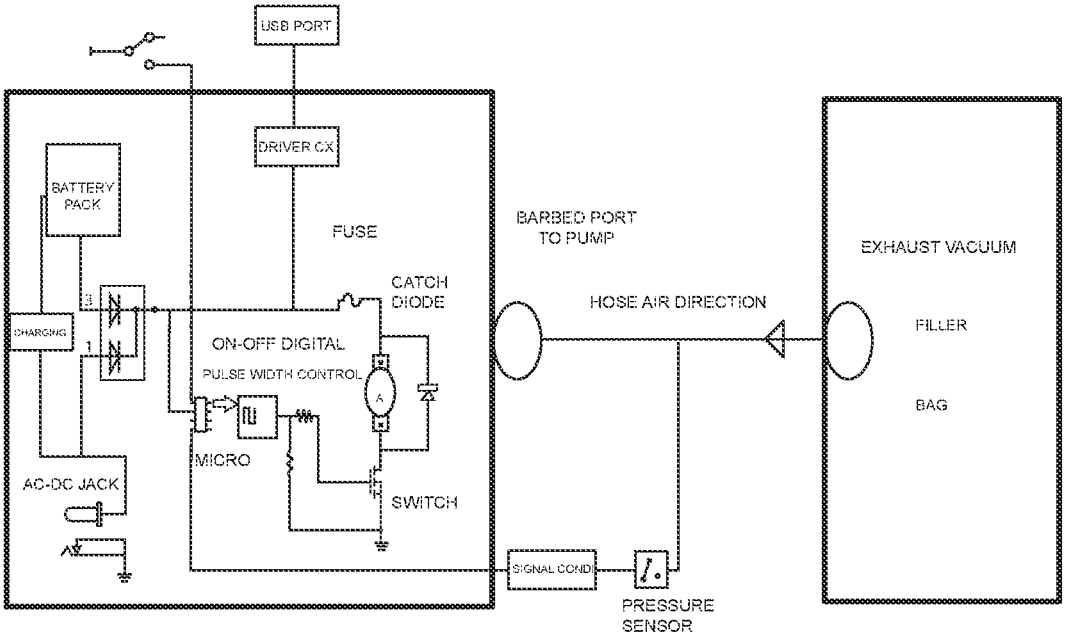
FIG. 24 is a wire diagram/electrical schematic for one non-limiting embodiment of the electrical component for the novel luggage in accordance with the present disclosure.
Figure 25:
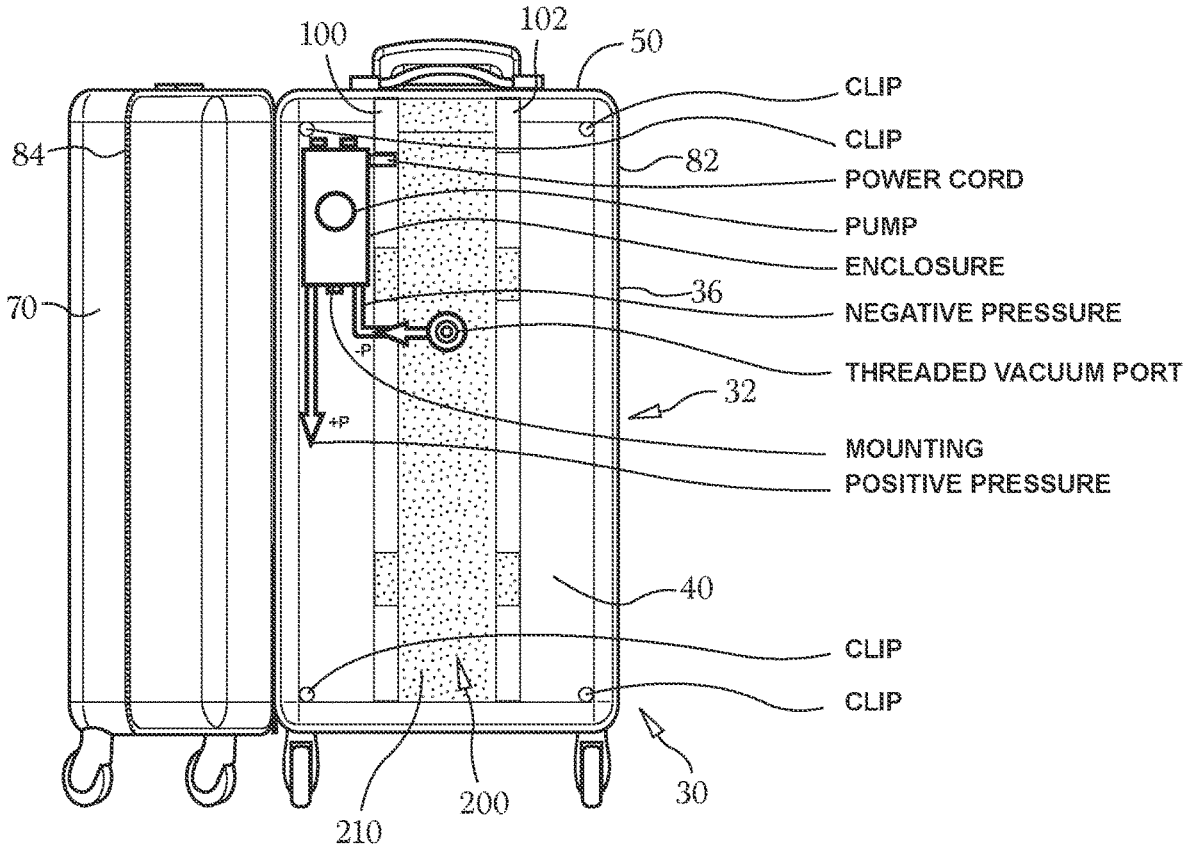
FIG. 25 is a front view of an additional non-limiting luggage embodiment with the compression bag removed in accordance with the present disclosure and with the luggage in an open configuration.
Figure 26:
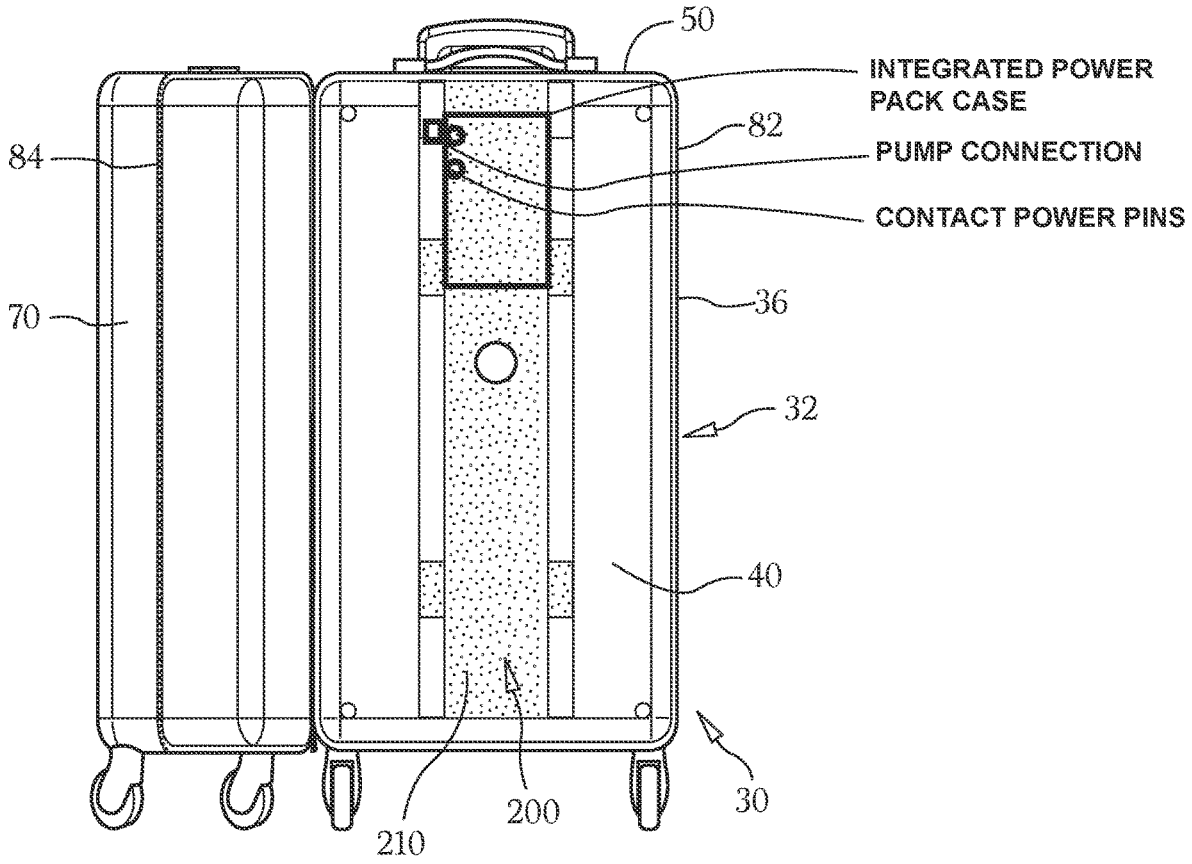
FIG. 26 is another front view of the additional non-limiting luggage embodiment with the compression bag removed in accordance with the present disclosure and with the luggage in an open configuration.

The electrical operation can be implemented with one or more features, and preferably, can be provided with several operational features. As seen in FIG. 24, in one non-limiting embodiment, the electrical diagram for the suitcase/luggage can be divided into four main components, which can include, without limitation, the power requirements and connections, the vacuum pump operation and functionality and the storage bag. As mentioned above, preferably the internal cavity of the suitcase can house all of the electrical and pneumatic components. FIGS. 25 and 26 illustrate another embodiment of the present disclosure, though including many of the same components/parts from the FIG. 3 embodiment, and such like parts retain the same reference numerals from FIG. 3. FIGS. 25 and 26 also illustrate new components not found in the FIG. 3 embodiment.

With respect to storage bag/compression bag functionality, the storage bag is seen preferably having an integrated filler hole. The filler hole serves as an exhaust vacuum hole. During operation, air from the bag can be evacuated through filler hole in conjunction with a connected air hose. The air hose can be preferably connected between the pump and the filler hole (exhaust) of the bag. In a non-limiting embodiment, a T-connector (pneumatic) can be provided in the middle of the line from the air hose going to a pressure sensor. The pressure sensor can be provided to read a pressure from zero to hundred kilo Pascal (or other desired range or values) and/or it can be programmed with the pressure range of the pump. The sensor can read and monitor the air flow between the pump and the storage bag. When the air flow drops to near zero or another predetermined/pre-programmed/pre-configured minimum, this measurement minimum air pressure level, when reached, can be detected by the pressure sensor to indicate that the pump has evacuated all of the air from the bag.

With the air evacuated from the bag, the pressure sensor can send a signal to the microprocessor controller through a pressure sensor signal pin, indicating there is no air flow and the microprocessor can send a signal/command to shut down the pump. The signal pin can be a voltage. Thus, the pressure sensor can be provided to monitor the air flow between the pump and the bag to determine when to shut down the pump. This feature has the following non-limiting benefits: (a) the pump will not continue to pump unnecessary air from the bag; (b) by shutting down the pump, battery energy from the pack can be saved; (c) the user does not need to shut down the pump, this will be automatic shutdown; and (d) the user does not have to guess whether or not all of the air has been evacuated out of the bag. With the preferred, but optional, pressure sensor employed, the user can merely load their clothes into the storage bag, seal the bag and press a switch that can be preferably externally accessible and located in an accessible area of the suitcase. The location of the pump power switch can be any location in the external area of the suitcase with best access to the consumer and is not considered limited to any one location.

One cycle operation that can be programmed into the microcontroller includes, without limitation, pressing a momentary digital switch dual setting (shown in FIG. 24 as momentary rocker switch). The momentary switch setting (i.e. which can be marked as Roman numeral I) can send a digital high pulse to the microcontroller indicating to the microcontroller to activate the pump motor. The momentary switch can receive the power from the power pack five-volt supply. The power pack can preferably have two separate operating voltages a five-volt output and a twelve-volt output, though such voltages are not considered limiting. The five-volt output can be used to power the USB out receptacles, while the twelve-volt output can be used for powering the pump. The microcontroller can be preferably programmed to generate a pulse to power "on" the pump. The pulse signal preferably is not a separate circuit. Rather, the pulses can be provided as a feature of the microcontroller. Once the microcontroller is activated, a pulse signal high can be sent out to the MOSFET which can be acting as a switch. The switch MOSFET allows power to the pump and closes the circuit. When on, the pump evacuates the air located within the from the air/compression bag. The pressure sensor is activated and monitors the air pressure. As mentioned above, once the air pressure drops below a previously set minimum air level/threshold, the pressure sensor is programmed or otherwise sends a signal to the microcontroller to shut down the pump. If after completing one cycle the user desires to extract additional air, the rocker momentary rocker switch can be manually pressed by the user or automatically pressed by the system to a secondary setting (i.e. which can be marked as Roman numeral II). When pressed (manually or automatically) a signal pulse is caused to be sent to power the pump. When manually pressed, the signal can be as long as the user holds down (i.e. manually) the switch at setting level II. A center setting for the momentary switch can be configured such that it is always neutral.

Figure 27:
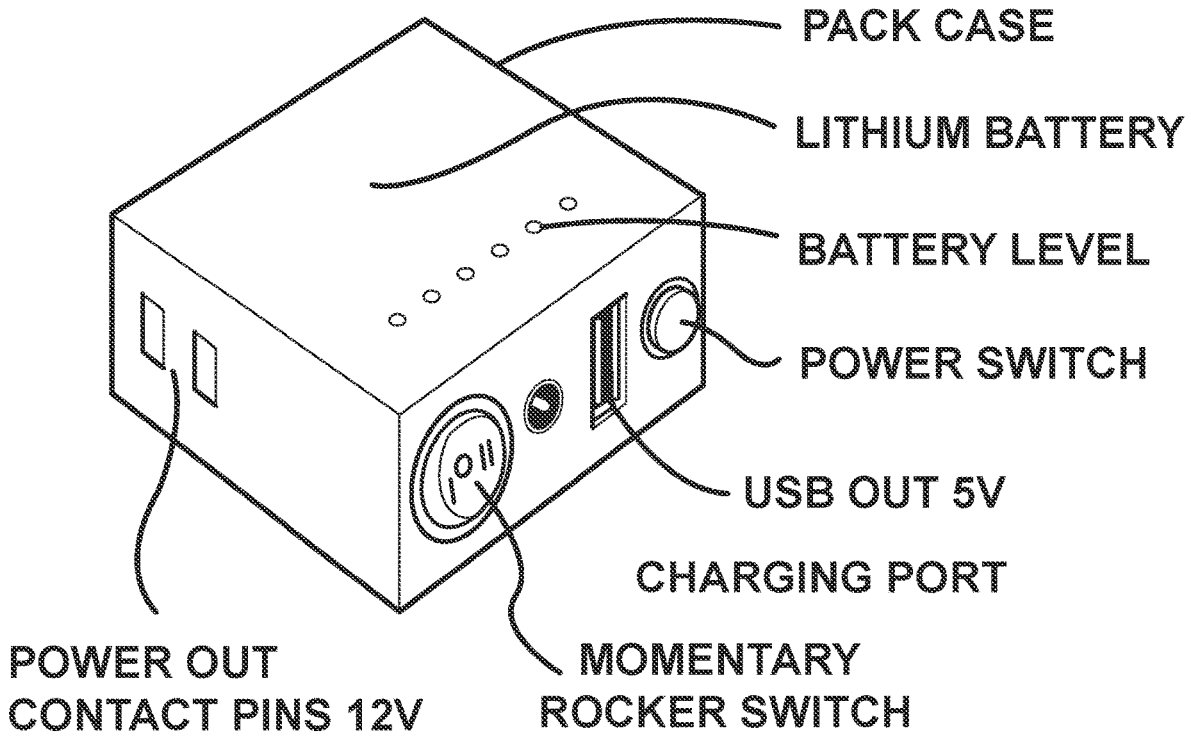
FIG. 27 is a perspective view of a non-limiting embodiment of the power pack that can be used with the novel luggage in accordance with the present disclosure.

A secondary momentary switch can also be provided in the face plate of the power pack for use in powering the USB ports by the power pack (See FIG. 27). Some non-limiting functions of the microcontroller can be to save power pack energy, control the pump and operate at lower temperature levels to prevent or reduce the chance of overheating.

As best seen in FIGS. 25 and 26, in one non-limiting embodiment, the pump can be directly connected to the power pack for powering the pump. Between the pump and the battery pack can be a safety device (i.e. fuse, breaker, etc.) to cut the power to the pump should a catastrophic failure or other failure or triggering event occur. Preferably, the pump can be powered only when the MOSFET switch is closed by the microprocessor signal biasing the gate pin.

In a preferred, though non-limiting embodiment, the battery pack can be a standard lithium battery pack with battery management system for balancing and protection to the cells. Non-limiting features of the preferred battery pack case can be USB power out 3.1, a recharging port and DC output jack. Though not required, the battery pack may also include a power cord, which can be removably or permanently attached to the battery pack.

As also mentioned above and seen in the non-limiting embodiment of FIGS. 25 and 26, suitcase 30 can be provided with a reserved area for the pump. The pump reserved area can be preferably located anywhere within the interior space/internal cavity and is preferably (though not limiting) disposed between the two handle guides/guide tubes. However, though not preferred, the pump can be located at other internal areas, such as an internal corner and all locations are considered within the scope of the disclosure. The pump reserve area can have a mounting means/mechanism to retain and secure the pump enclosure. Suitcase/luggage 30 can also be provided with clips in each respective corner to secure the compression bag. The material used for the clips can be any material suitable for such application and all such materials are considered within the present disclosure. The storage bag can have various shapes such as rectangular, t-shape, double stack, etc. and all shapes are considered within the present disclosure.

Suitcase 30 can also integrate an exhaust port with thread options for bag retention and secureness. The vacuum fill hole (i.e. exhaust) to extract/evacuate the air from the bag can be preferably attached to the center back mounting member or hole at or in the center of the suitcase. Other locations for the mounting location (i.e. other areas on the back wall, side walls, front wall, etc.) can also be selected and are considered within the scope of the disclosure. A screw-on cap can be provided so the bag can always be preferably attached. In this embodiment, no air exit hole (like opening 216) is needed. The compression bag can be secured to the vacuum pump, such as by a screw on fill or exhaust air port, preferably, located in the center of the bag, though other locations on the bag can be selected and are considered within the scope of the disclosure. The vacuum line from the pump is preferably connected to the bag's threaded airport.

In one preferred, non-limiting embodiment no exhaust hole through the back wall of the suitcase/luggage is needed, such that the air can be exhausted out of the compression bag as described above to allow more items/clothing to be contained within the bag, while the exhausted/evacuated air is moved to other areas of the luggage/suitcase without interfering with the operation of the compression bag, or the air can be released from within the suitcase/luggage through the opening for inserting/removing the battery or by traditionally fully or partially opening the suitcase (i.e. while maintaining the bag itself in a fully sealed air evacuated state) during or after operation of the pump.

Though not limiting, the pump enclosure can be preferably made out of ABS material with a high flammability rating of VO as per UL plastic rating. The pump enclosure can have a plurality, and preferably dual pressure port outlets. One pressure port outlet can be a positive pressure and the second outlet can be a negative pressure (See "long arrow" in FIG. 25). The outlet port can be a barbed port connection or any other preferable port suitable for the application. The enclosure can also have mounting means suitable for the application. The enclosure can have a channel outlet for power cord conductors to power the pump with a strain relief. The conductor of the pump can be a dual connector or a conductor with it and can connect with locking means that can be connected to the battery power case.

The positive pressure port can vent into the cavity of the suitcase. The negative pressure port can be attached to the thread of the bag extract port/vacuum port (i.e. bag air port). Though not considered limiting, the pump can have a flow rate of 1 L per minute vacuum as a minimum and a pressure range of minimum of 70 kilo pascal. Again, not limiting, the pump can have an operating voltage of 12 V DC or 20 V DC with a noise ratio of 65 dB average. The pump motor can drive the air diaphragm pump, not a piston. Additionally, the pump can have retaining features for cushioning vibration control. As referenced above, the pump location within the suticase shown in the drawings is representative, but not considered limiting, and the pump can be located within the suitcase at any available space within the suitcase internal cavity. As also mentioned above, preferably the pump can be user remvoable. Thus, the pump can be removable from its preferred, but non-limiting, internal location between the guide tubes, as well as any other location it is disposed at within the suitcase internal cavity.

As seen in FIGS. 25 and 26, in one non-limiting embodiment, the suitcase can integrate an enclosure to housed a power pack. In a preferred, non-limiting embodiment, the power pack can be a lithium power pack (See FIG. 27. The preferred intergated enclosure of the suitcase can contain a pump connection/quick connect receptacle. The preferred quick connected recptacle can receive the incoming connection from the pump. The quick connect can be located in the outer portion of the intergated enclosure. The enclosure also includes an outer wall and inner wall. The inner wall of the intergated enclosure can be provided to allow the power pack to be preferably removable from the enclosure. The integrated enclosure preferably contains receptacle pins/contact power pins that can be in contact with the contact pins of the power pack, when the power pack is inserted within the enclosure. The pins can be contact pins to provide power to the pump from the power pack.

The center cavity as previously described, can be an intergated cavity to store the removable power pack. In one non-limiting embodiment, the power pack, as shown in FIG. 27, can be provided with the following features: (a) Second switch for 12 V pump, (b) $1^{st}$ setting ON—Automatic, (c) Center OFF—NEUTRAL, (4) $3^{rd}$ setting momentary manual hold pump extra exhaust.

Figure 28:
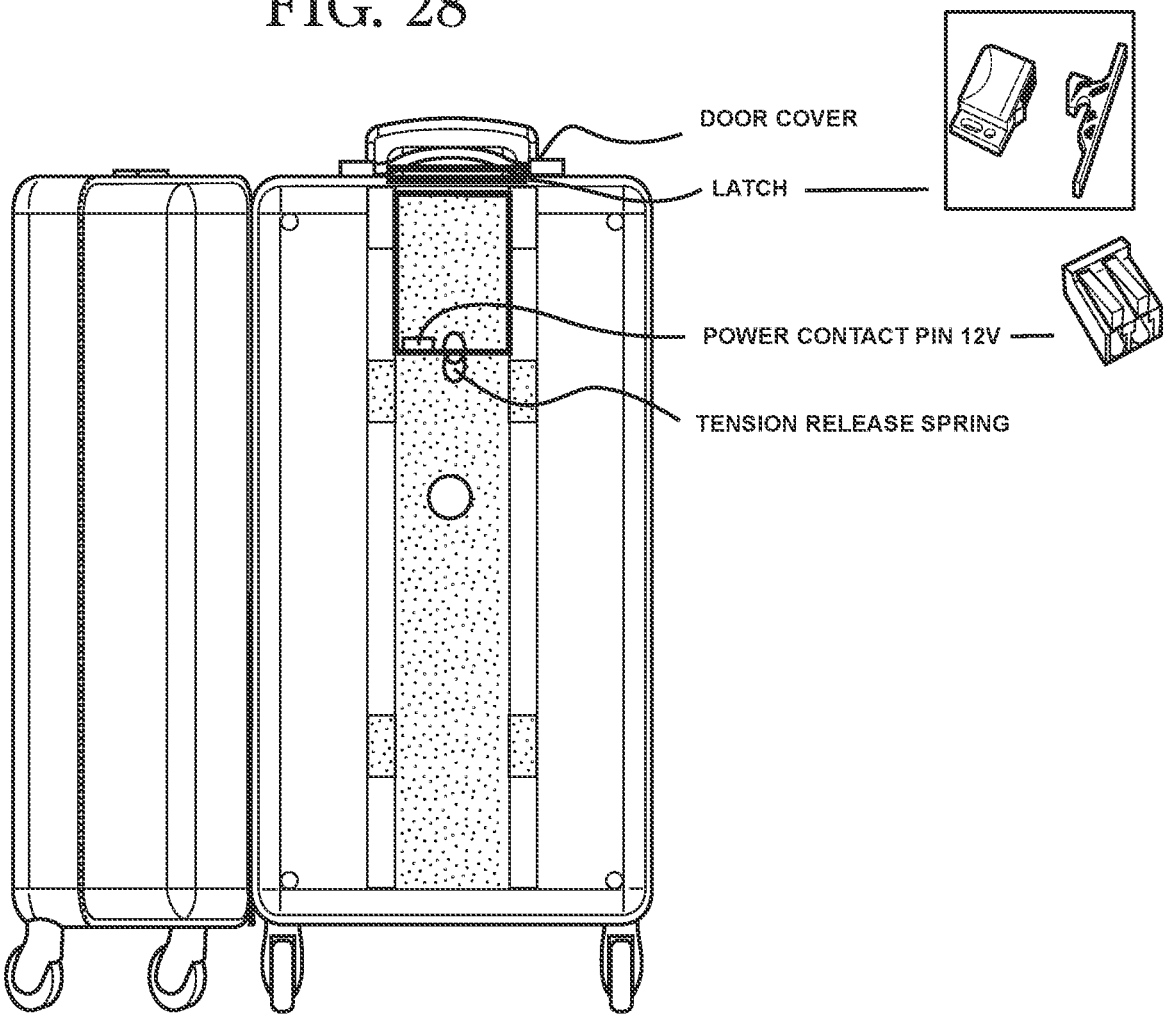
FIG. 28 is a front view of the additional non-limiting luggage embodiment with the compression bag removed and illustrating one non-limiting embodiment for the power supply cavity for the novel luggage in accordance with the present disclosure.

As seen in FIG. 28, one non-limiting embodiment for the internal cavity used for the power supply is shown. The internal cavity can be used for the motor and/or the power supply integrated components. In one non-limiting preferred operation embodiment for the power supply, a suitcase power supply cover can be opened to then allow the power supply to be inserted into the internal cavity. The power supply can be provided with a side built-in lever for a latch to lock. The power supply can be pushed by the user until it locks with the side latches. Power supply push pump contact pins can be provided, and the power supply can be provided with similar contact pins for connection. At this point the power supply can be considered properly secured and the suitcase power supply cover can be covered. To release the power supply, preferably with the supply cover opened, the latches can be slid to the side and the power supply ejected slightly by the tension release spring.

The compression bag used with the embodiment shown in FIGS. 27 and 28 can also be removable from its internal connection within the suitcase.

As seen above, a suitcase/luggage is disclosed preferably containing a built-in compression bag and integrated vacuum source. The suitcase provides a user/traveler with an easier way to pack, as compared to traditional luggage, by maximizing the space available inside a travel suitcase. Preferably, the novel suitcase can come equipped with an integrated compression bag, pump and power supply. In one non-limiting use, the user packs their clothes inside the compression bag within the suitcase, closes the compression bag opening and activates the pump. The pump compresses the bag (e.g. over 40%, etc.) allowing the user to maximize the storage space available within the suitcase. A built-in pressure sensor and micro-controller can be provided for maintaining accuracy.

Figure 29:
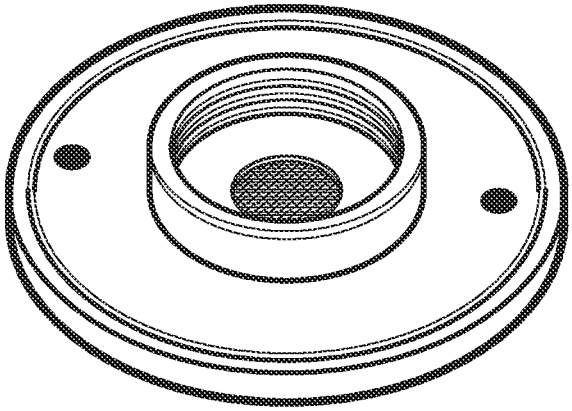
FIG. 29 is a perspective view of a non-limiting exhaust port with threaded top in accordance with the present disclosure.
Figure 30:
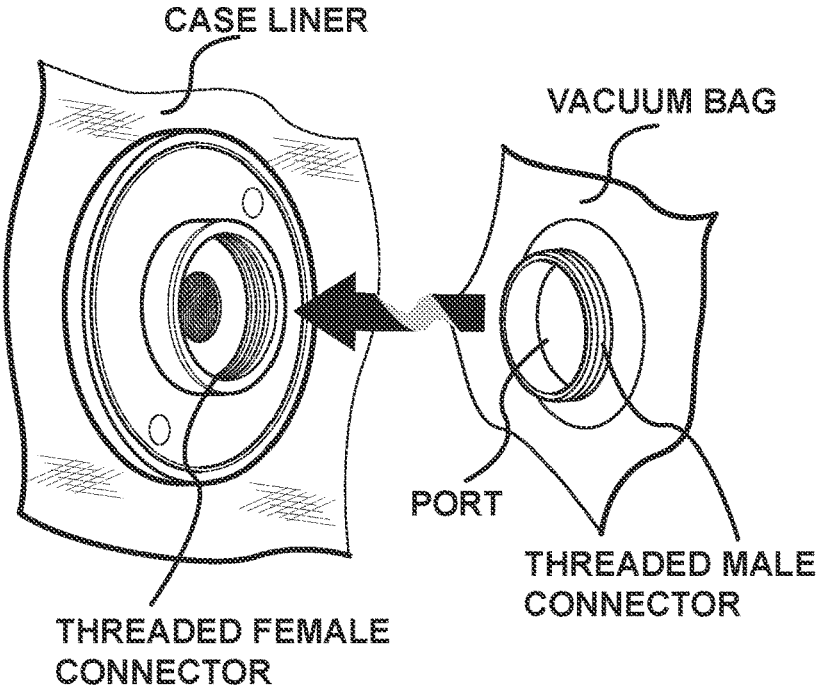
FIG. 30 is a perspective view of a non-limiting threaded exhaust port and bag/compression bag in accordance with the present disclosure.
Figure 31:
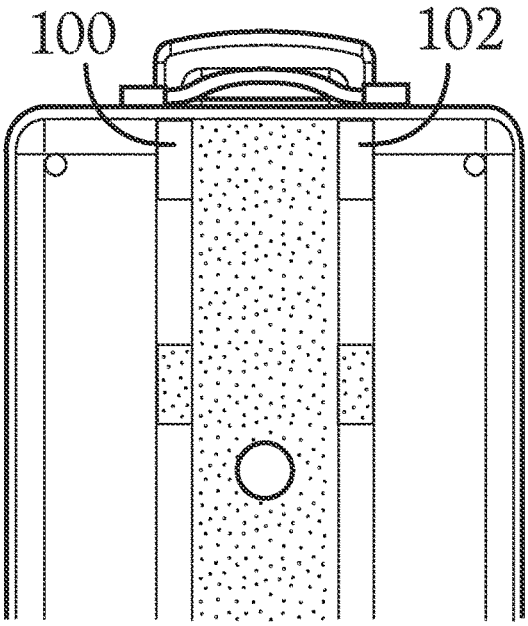
FIG. 31 is a perspective view of one non-limiting location for the exhaust in accordance with the present disclosure.

FIGS. 29 through 31 show the compression/storage bag which preferably gets screwed-on to an exhaust port (FIG. 29) which can be provided with a screw-like thread. The opening in the bag from removing the air can be provided with a mechanical fastener/connection member that mates with the exhaust port. Other ways of allowing the storage bag to be in gas/air communication and connected with respect to the exhaust port can also be used and are considered within the scope of the disclosure. The vacuum hose of the pump can be attached to the other end of the exhaust. Preferably, in use the pump/vacuum and vacuum hose are hidden behind the suitcase liner. The exhaust power/port can be mounted to the suitcase liner, preferably, permanently mount, though such is not consider limiting.

Figure 32:
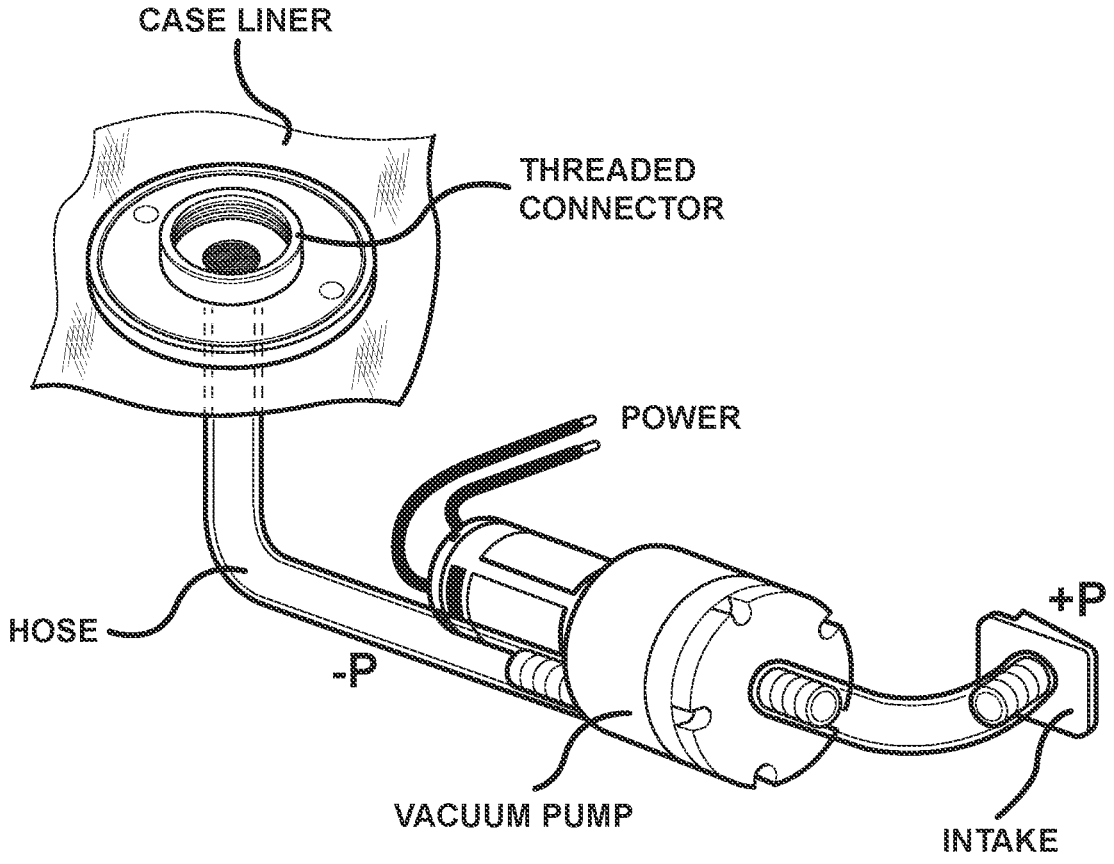
FIG. 32 is a perspective view of one non-limiting location and connection between the pump vacuum hose and the exhaust port.
Figure 33:
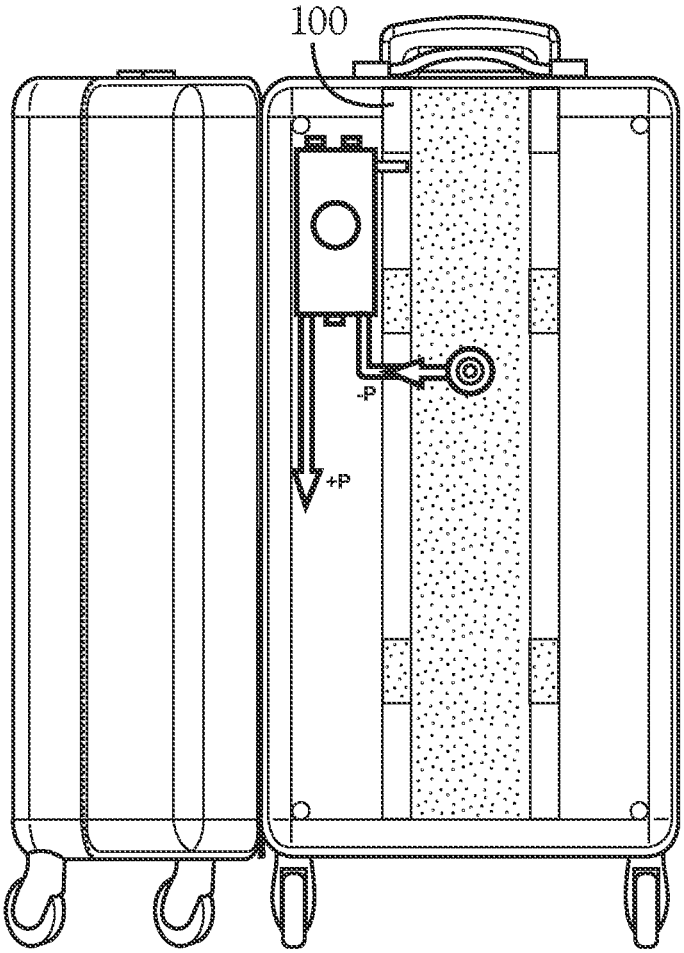
FIG. 33 is a front view of a represent view showing the connection between the hose and exhaust port with the pump located to the side for visibility and not to represent its preferred location, which is preferably (though not limiting) behind the liner between the internal handle guides in accordance with the present disclosure.

As seen in FIG. 32, the pump vacuum hose is preferably attached to the exhaust port underneath or behind the suitcase liner. When the pump is powered the air is extracted from the storage bag. The vacuum hose can be permanently attached to the exhaust port, though such is not considered limiting and it is also within the scope of the disclosure for a non-permanent attachment between the hose and exhaust port and the exhaust port to the suitcase liner. Preferably, the pump pressure can be released freely inside the liner and no connection is necessary.

Figure 34A:
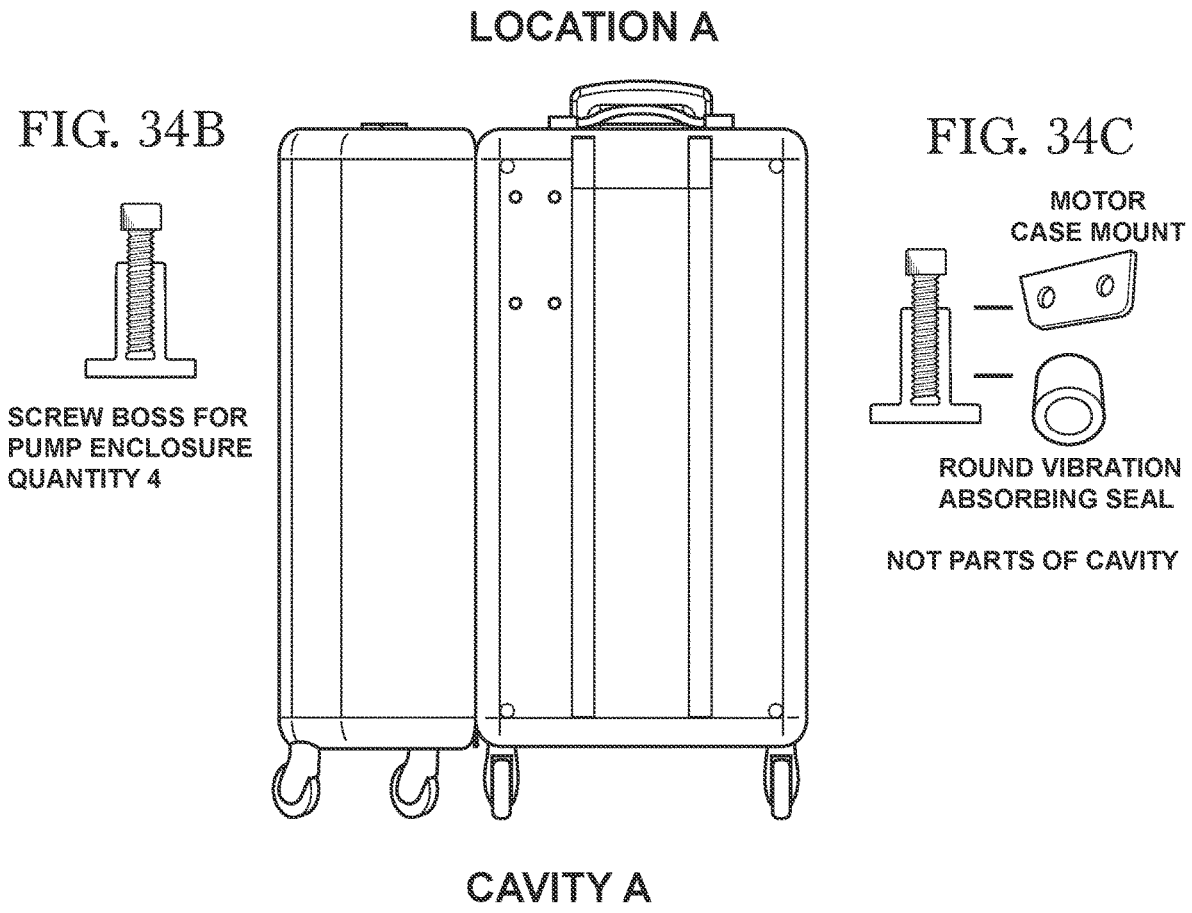
FIG. 34A illustrates a non-limiting internal area location for securing the pump within the suitcase in accordance with the present disclosure.

Wherever the location for the pump is chosen it can be secured preferably by mechanical fasteners, including, without limitation, by a plurality of screws (See FIG. 34). In one non-limiting embodiment, screw bosses can be provided for receipt of the screws and can provide for a round vibration absorbing seal.

The word "conduit" refers to any item capable of transporting air/gas including, without limitation, pipes, lines, piping, tubes, pipelines, tubing, conduits, hoses, cannulas, cylinders, etc.

The word "box" or "housing" refers to the structure that is used for containing the self-contained vacuum assembly components and securing such within the interior of the luggage, whether to the guide tubes and/or to the shell. The box or housing is not considered limited to any particular shape or dimensions, but in a preferred embodiment, can be square or rectangularly sized and shape and sized to fit between the two guide tubes and sized such that all of the vacuum components (hoses, pump, conduits, etc.) are contained within the box/housing and not exposed within the interior space of the shell, such that the entire vacuum assembly can be quickly removed from within the interior space of the shell by simply removed the box/housing from its removable/releasable attachment within the shell preferably between the guide tubes.

References to luggage shall also include suitcase, and vice versa, as well as other similarly used terms to describe portable structures used for traveling/packing purposes. Additionally, the concepts and features described above can be incorporated into and applicable for both carry-on and checked suitcases/luggage.

In one non-limiting embodiment, the shell and front member can be or are conventional components, parts, materials currently used within luggage construction, though the various openings in these components for air removal, incorporating the control panel, externally inserting and removing the battery from within battery receiving cavity, etc. are considered novel and not part of conventional parts previously used in luggage construction.

It should be understood that the exemplary embodiments described herein should be considered in a descriptive sense only and not for purposes of limitation. Descriptions of features or aspects within each embodiment should typically be considered as available for other similar features or aspects in other embodiments. While one or more embodiments have been described with reference to the Figures, it will be understood by those of ordinary skill in the art that various changes in form and details may be made therein without departing from their spirit and scope.

All components of the described system and their locations, electronic, gas/air and mechanical communication/connection methods between the system components, pumps, power sources, shell materials, bag materials, valves, dimensions, materials, cases, values, etc. discussed above or shown in the drawings, if any, are merely by way of example and are not considered limiting and other component(s) and their locations, electronic, gas/air and mechanical communication/connection methods between the system components, pumps, power sources, shell materials, bag materials, valves, dimensions, materials, cases, values, etc. can be chosen and used and all are considered within the scope of the disclosure.

Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the novel piece of luggage has been described and disclosed in certain terms and has disclosed certain embodiments or modifications, persons skilled in the art who have acquainted themselves with the disclosure, will appreciate that it is not necessarily limited by such terms, nor to the specific embodiments and modification disclosed herein. Thus, a wide variety of alternatives, suggested by the teachings herein, can be practiced without departing from the spirit of the disclosure, and rights to such alternatives are particularly reserved and considered within the scope of the disclosure.

What is claimed is:

1. A piece of luggage comprising:

a shell having a sidewall and a back wall defining an interior space, the sidewall including an upper wall portion having an opening;

a handle having a first elongated member and a second elongated member and an externally accessible cross member secured to a first end of the first elongated member and a first end of the second elongated member, the handle movable from a fully retracted position to a fully extended portion with respect to the upper wall portion of the sidewall;

a first handle guide secured to an interior surface of the back wall within the interior space;

a second handle guide secured to the interior surface of the back wall within the interior space, the first handle guide and the second handle guide defining a first area therebetween within the interior space;

wherein a second end of the first elongated member disposed within the first handle guide and movable within the first handle guide and a second end of the second elongated member disposed within the second handle guide and movable within the second guide;

a removable pump assembly disposed and secured within the interior space;

a power source receiving member disposed and secured within an upper portion of the first area adjacent to the upper wall portion; the power source receiving member having a receiving cavity which is aligned with and externally accessible through the opening in the upper wall portion;

one or more electrical contact pins disposed within the receiving cavity;

a removable power source disposed and removably inserted within the receiving cavity through the opening in the upper wall portion, the removable power source having one or more electrical contacts that are in electrical communication with the one or more electrical contact pins when the removable power source is disposed within the receiving cavity; the removable power source in electrical communication with the pump assembly to provide power for the pump assembly;

a compression bag secured within the interior space, the compression bag having a first closable opening wherein clothes and items can be inserted within the compression bag and a second opening, the compression bag is connected to the removable pump assembly at the second opening of the compression bag;

a front member or cover secured to the shell, wherein in a cover closed position the interior space is externally inaccessible and in a cover opened position the interior space is accessible to provide access to the compression bag and any contents contained therein and to remove the pump assembly;

wherein in operation, with the first opening of the compression bag closed, air is evacuated out of the air compression bag through the second opening by the removable pump assembly.

2. The piece of luggage of claim 1 wherein the pump assembly is secured within a lower portion of the first area.

3. The piece of luggage of claim 1 wherein air withdrawn from the compression bag by the removable pump assembly is release out of the pump assembly into the interior space of the shell.

4. The piece of luggage of claim 1 further comprising a suitcase liner internally disposing within the interior space and hiding the first handle guide and the second handle guide; and an exhaust port secured to the suitcase liner.

5. The piece of luggage of claim 4 wherein the compression bag secured to the exhaust port to allow air to be drawn out of the compression bag through the second opening and through the exhaust port.

6. The piece of luggage of claim 5 further comprising a vacuum hose secured at one end to the pump and at an opposite second end to the exhaust port.

7. The piece of luggage of claim 6 further comprising a microcontroller and a sensor in electrical communication with the microcontroller, the sensor in communication with an internal passageway of the vacuum hose; wherein based on information received from the sensor when the microcontroller determines that all or a sufficient amount of air has been withdrawn from the compression bag the microcontroller is programmed to automatically send a signal to the pump to automatically turn the pump off.

8. The piece of luggage of claim 7 wherein the sensor is a pressure sensor.

9. The piece of luggage of claim 1 wherein the first handle guide extends from the upper wall portion to a bottom wall portion within the interior space and the second guide extends from the upper wall portion to the bottom wall portion within the interior space.

10. The piece of luggage of claim of claim 1 wherein the vacuum assembly removably secured to the shell by a plurality of boss/screw connections.

11. The piece of luggage of claim 1 wherein the compression bag in an uncompressed state extends over the shell.

12. The piece of luggage of claim 1 wherein the compression bag is removably connected to the shell by a plurality of clips, with each clip of the plurality of clips located in a corresponding corner of the interior space.

13. The piece of luggage of claim 1 wherein the vacuum assembly is a self-contained vacuum having an outer box or housing.

14. The piece of luggage of claim 1 wherein the cross member of the handle covers the opening and the power source inserted within the receiving cavity when the handle is in a fully retracted position.

15. The piece of luggage of claim 1 wherein the power pack receiving cavity is externally accessible through the opening in the upper wall portion of the shell such that the battery can be externally inserted within and externally taken out of the battery receiving cavity through the upper wall portion in the cover closed position.

16. The piece of luggage of claim 1 wherein a portion of the front member permanently secured to a portion of an edge of the sidewall and a remaining portion of the front member releasably secured to a remaining edge portion of the sidewall.

17. The piece of luggage of claim 16 wherein the releasable securement between the front member and the remaining edge portion is through a waterproof zipper assembly.

18. The piece of luggage of claim 1 wherein the power source receiving member permanently secured to the shell, first handle guide or second handle guide.

19. The piece of luggage of claim 1 wherein the pump assembly is secured to the shell.

20. The piece of luggage of claim 1 wherein the receiving member is fully disposed within the interior space defined by the shell at all times.

21. A piece of luggage comprising:

a shell having a sidewall and a back wall defining an interior space, the sidewall including an upper wall portion having an opening;

a handle having a first elongated member and a second elongated member and an externally accessible cross member secured to a first end of the first elongated member and a first end of the second elongated member, the handle movable from a fully retracted position to a fully extended portion with respect to the upper wall portion of the sidewall;

a first handle guide secured to an interior surface of the back wall within the interior space;

a second handle guide secured to the interior surface of the back wall within the interior space, the first handle guide and the second handle guide defining a first area therebetween within the interior space;

wherein a second end of the first elongated member disposed within the first handle guide and movable within the first handle guide and a second end of the second elongated member disposed within the second handle guide and movable within the second guide;

a removable pump assembly disposed and secured within the interior space;

a power source receiving member permanently disposed fully within the interior space at all times and secured within an upper portion of the first area adjacent to the upper wall portion; the power source receiving member having a receiving cavity which is aligned with and externally accessible through the opening in the upper wall portion;

one or more electrical contact pins disposed within the receiving cavity;

a power pack removably inserted and secured within the a power pack receiving cavity through the opening in the upper wall portion, the power pack having one or more electrical contacts that are in electrical communication with the one or more electrical contact pins when the power pack is disposed within the receiving cavity; the power pack when positioned within the receiving cavity in electrical communication with the pump assembly to provide power for the pump assembly;

a compression bag secured within the interior space, the compression bag having a first closable opening wherein clothes and items can be inserted within the compression bag and a second opening, the compression bag is connected to the removable pump assembly at the second opening of the compression bag; and a front member or cover secured to the shell, wherein in a cover closed position the interior space is externally inaccessible and in a cover opened position the interior space is accessible to provide access to the compression bag and any contents contained therein and to remove the pump assembly;

wherein in operation, with the first opening of the compression bag closed, air is evacuated out of the air compression bag through the second opening by the removable pump assembly.

22. The piece of luggage of claim 21 wherein the cross member of the handle covers the opening and the power pack inserted within the receiving cavity when the handle is in a fully retracted position.

23. The piece of luggage of claim 21 wherein the receiving cavity is externally accessible through the opening in the upper wall portion of the shell such that the power pack can be externally inserted within and externally taken out of the receiving cavity through the upper wall portion in the cover closed position.

24. A piece of luggage comprising:

a shell having a sidewall and a back wall defining an interior space, the sidewall including an upper wall portion having an opening;

a handle having a first elongated member and a second elongated member and an externally accessible cross member secured to a first end of the first elongated member and a first end of the second elongated member, the handle movable from a fully retracted position to a fully extended portion with respect to the upper wall portion of the sidewall;

a first handle guide secured to an interior surface of the back wall within the interior space;

a second handle guide secured to the interior surface of the back wall within the interior space, the first handle guide and the second handle guide defining a first area therebetween within the interior space;

wherein a second end of the first elongated member disposed within the first handle guide and movable within the first handle guide and a second end of the second elongated member disposed within the second handle guide and movable within the second guide;

a removable pump assembly disposed and secured within the interior space;

a power source receiving member permanently disposed fully within the interior space at all times and secured within an upper portion of the first area adjacent to the upper wall portion; the power source receiving member having a receiving cavity which is aligned with and externally accessible through the opening in the upper wall portion;

one or more electrical contact pins disposed within the receiving cavity;

a power pack removably inserted and secured within the receiving cavity through the opening in the upper wall portion, the power pack having one or more electrical contacts that are in electrical communication with the one or more electrical contact pins when the power pack is disposed within the receiving cavity; the power pack when positioned within the receiving cavity in electrical communication with the pump assembly to provide power for the pump assembly, the receiving cavity is externally accessible through the opening in the upper wall portion of the shell such that the power pack can be externally inserted within and externally taken out of the receiving cavity through the upper wall portion in the cover closed position;

a compression bag secured within the interior space, the compression bag having a first closable opening wherein clothes and items can be inserted within the compression bag and a second opening, the compression bag is connected to the removable pump assembly at the second opening of the compression bag; and a front member or cover secured to the shell, wherein in a cover closed position the interior space is externally inaccessible and in a cover opened position the interior space is accessible to provide access to the compression bag and any contents contained therein and to remove the pump assembly;

wherein in operation, with the first opening of the compression bag closed, air is evacuated out of the air compression bag through the second opening by the removable pump assembly;

wherein the cross member of the handle covers opening and the power pack inserted within the receiving cavity when the handle is in a fully retracted position.

* * * * *